US012297652B2

(12) United States Patent
Claro Carrascal

(10) Patent No.: US 12,297,652 B2
(45) Date of Patent: May 13, 2025

(54) FORMWORK MECHANISM FOR CASTING AND MOULDING CONCRETE, COMPRISING A COFFER WITH A SHEET AND FOUR PLATES ARRANGED AROUND THE SHEET'S PERIMETER

(71) Applicant: Domingo De Guzman Claro Carrascal, Medellín (CO)

(72) Inventor: Domingo De Guzman Claro Carrascal, Medellín (CO)

(73) Assignee: Domingo De Guzman Claro Carrascal, Medellín (CO)

( * ) Notice: Subject to any disclaimer, the term of this patent is extended or adjusted under 35 U.S.C. 154(b) by 0 days.

(21) Appl. No.: 18/345,658

(22) Filed: Jun. 30, 2023

(65) Prior Publication Data

US 2023/0340793 A1 Oct. 26, 2023

Related U.S. Application Data

(63) Continuation of application No. 16/474,042, filed as application No. PCT/IB2017/058387 on Dec. 23, 2017, now abandoned.

(30) Foreign Application Priority Data

Dec. 26, 2016 (CO) ..... NC2016/0005799

(51) Int. Cl.
*E04G 11/46* (2006.01)
*E04B 1/16* (2006.01)
(Continued)

(52) U.S. Cl.
CPC ..... *E04G 11/46* (2013.01); *E04B 1/166* (2013.01); *E04B 1/3205* (2013.01); *E04G 9/10* (2013.01);
(Continued)

(58) Field of Classification Search
CPC ..... E04G 11/46; E04G 9/10; E04G 11/08; E04G 17/001; E04G 17/042; E04G 17/14;
(Continued)

(56) References Cited

U.S. PATENT DOCUMENTS 1,160,384 A * 11/1915 Crane ..... E04B 5/21 52/577
1,331,096 A * 2/1920 Eaches ..... E04G 13/028 249/188
(Continued)

FOREIGN PATENT DOCUMENTS

BR PI0903633 5/2011
BR PI0618225 A2 * 8/2011
(Continued)

*Primary Examiner* — Phi D A
(74) *Attorney, Agent, or Firm* — Armstrong Teasdale LLP

(57) ABSTRACT

The present invention corresponds to a formwork mechanism for casting and molding concrete, comprising a coffer having a sheet and four plates around the sheet perimeter. Each plate has holes arranged on its front face. Also, the formwork mechanism includes a structural element, connected to one of the plates by fixing means. On the other hand, the structural element has lateral perforations that are aligned with the holes of one of the coffer plates. Fixing means pass through the holes and side holes. The structural element may be a beam, a three or four-beam T, and combinations thereof. On the other hand, using several coffers interconnected with structural elements, formworks are constructed for casting flat reticular slabs; and also for curved reticular slabs with greater slab thickness near the beams supporting the slabs in comparison to the span of the slabs.

27 Claims, 17 Drawing Sheets

(51) Int. Cl.

| | |
|---|---|
| ***E04B 1/32*** | (2006.01) |
| ***E04G 9/10*** | (2006.01) |
| ***E04G 11/08*** | (2006.01) |
| ***E04G 17/00*** | (2006.01) |
| ***E04G 17/04*** | (2006.01) |
| *E04G 17/14* | (2006.01) |

(52) U.S. Cl.
CPC ..... *E04G 11/08* (2013.01); *E04G 17/001* (2013.01); *E04G 17/042* (2013.01); *E04B 2001/3294* (2013.01); *E04G 17/14* (2013.01)

(58) Field of Classification Search
CPC ..... E04G 13/04; E04G 9/02; E04G 11/36; E04G 11/38; E04G 11/40; E04G 11/48; E04G 21/26; E04B 1/166; E04B 1/3205; E04B 2001/3294; E04B 5/326
See application file for complete search history.

(56) References Cited

U.S. PATENT DOCUMENTS 1,379,820 A 5/1921 Hopkins
1,473,964 A * 11/1923 Moore ..... E04G 13/026 249/157
1,507,046 A 9/1924 Cockerell et al.
1,534,215 A * 4/1925 Hopkins ..... E04G 11/46 249/29
1,556,324 A 10/1925 Goldsmith
1,562,819 A 11/1925 Badt
1,564,541 A 12/1925 Dodd
1,579,822 A * 4/1926 Knickerbocker ..... E04G 11/02 425/DIG. 57
1,596,284 A * 8/1926 Malmgren ..... E04G 11/46 249/176
1,713,100 A * 5/1929 Soule ..... E04G 11/46 249/177
1,824,816 A 9/1931 Goldsmith
2,038,296 A * 4/1936 Kendrick ..... E04G 11/48 249/29
2,206,939 A * 7/1940 Carilli ..... E04B 5/32 249/31
2,232,112 A 2/1941 Hubbell et al.
2,595,286 A * 5/1952 Otte ..... E04G 13/023 249/165
2,734,250 A 2/1956 Thompson
2,881,501 A * 4/1959 Raney ..... E04G 11/46 425/DIG. 29
3,130,470 A * 4/1964 Bowden ..... E04G 11/48 211/186
3,130,471 A 4/1964 Zimmerschied et al.
3,182,948 A * 5/1965 Lawrence ..... E04G 11/32 249/126
3,224,725 A 12/1965 Matteson
3,314,638 A * 4/1967 Morrison ..... E04G 11/50 249/176
3,471,117 A * 10/1969 Haney ..... E04G 11/46 249/176
3,584,826 A * 6/1971 Liester ..... E04G 9/10 249/35
3,638,902 A * 2/1972 Bergan ..... E04G 11/46 249/31
3,647,173 A * 3/1972 Pipala ..... E04G 11/486 249/31
3,661,354 A * 5/1972 Dagiel ..... E04G 11/12 249/192
3,695,574 A * 10/1972 Charlier ..... B28B 7/28 249/175
3,807,681 A 4/1974 Kane
3,857,540 A * 12/1974 Ecker ..... E04G 17/001 220/4.28
3,931,952 A 1/1976 Dashew
4,356,993 A * 11/1982 Gallis ..... E04G 17/001 249/27
4,486,000 A * 12/1984 Klaiss ..... E04G 11/40 249/23
4,492,358 A * 1/1985 Manderla ..... E04G 11/52 249/31
4,717,517 A * 1/1988 Halberstadt ..... E04G 11/02 249/47
5,291,716 A * 3/1994 Broberg ..... E04B 1/3483 52/745.03
5,397,096 A * 3/1995 Nelson ..... E04G 11/46 249/176
5,398,909 A * 3/1995 Sandwith ..... E04G 11/50 249/207
6,668,511 B2 * 12/2003 Xammar ..... E04G 13/023 52/302.5
6,676,102 B1 * 1/2004 Hambelton ..... E04G 13/023 249/189
8,827,235 B1 * 9/2014 Fisher, III ..... E04G 11/08 249/35
9,068,363 B2 * 6/2015 Rojas Pimiento .... E04G 13/025
9,731,433 B1 * 8/2017 Shumaker ..... B28B 7/0029
10,066,404 B2 * 9/2018 Parodi ..... E04G 15/061
11,008,765 B2 * 5/2021 Johnson ..... E04G 13/02
2004/0056172 A1 * 3/2004 Sedran ..... E04G 9/05 249/35
2009/0056258 A1 * 3/2009 Currier ..... E04G 17/06 52/649.1
2014/0263941 A1 * 9/2014 Zhang ..... E04G 11/06 249/18
2016/0115698 A1 * 4/2016 Parodi ..... E04G 17/00 249/188
2021/0252683 A1 * 8/2021 Chevis ..... F16B 37/122
2022/0228381 A1 * 7/2022 Li ..... E04G 17/042

FOREIGN PATENT DOCUMENTS

CH 343114 A 12/1959
CH 400534 A 10/1965
DE 882907 C 7/1953
DE 2852804 A1 6/1979
DE 3426642 A1 * 1/1986
DE 202015003841 10/2015
EP 0131030 9/1986
EP 1236843 9/2002
ES 2013803 A6 6/1990
ES 2219129 11/2004
FR 1004503 A 3/1952
FR 2395366 A1 1/1979
GB 556806 10/1943
GB 803839 11/1958
KR 100662815 12/2006
KR 20070008147 A 1/2007
KR 20080001874 U 6/2008
KR 20110126401 11/2011
KR 101170545 8/2012
KR 20120089345 8/2012
KR 101264411 B1 5/2013
MX 2013011135 3/2015
WO WO200828986 3/2008
WO WO-2009067723 A2 * 5/2009 ..... B28B 7/164
WO WO2013171772 11/2013

* cited by examiner

FORMWORK MECHANISM FOR CASTING AND MOULDING CONCRETE, COMPRISING A COFFER WITH A SHEET AND FOUR PLATES ARRANGED AROUND THE SHEET'S PERIMETER

FIELD OF THE INVENTION

The present invention relates to formwork structures and mechanisms for casting and molding of concrete, particularly with formworks for casting and molding of reticular slabs.

PRIOR ART DESCRIPTION

Prior art discloses formwork systems for molded concrete structures, such as the system disclosed in U.S. Pat. No. 9,068,363 B2.

U.S. Pat. No. 9,068,363 B2 discloses a metal formwork system for molded concrete structures. The system comprises a metal panel, and connection accessories such as an adjustable corner, a right angle laminated profile, a profile with welded pins, plates, spacers, aligners, liner holders and pins (e.g. wedge pin). The accessories allow different forms to be formed with the panels. Each panel has perforations in which the accessories are connected. In the flat part of the panels there are perforations in which spacers are connected graduating the distance between two plates facing each other; each spacer has a rod with a threaded end, a plate located in the opposite end to the threaded end, a nut that is connected to the threaded end, which has a connection that is coupled to a wrench, between the plate and the nut the panels being arranged. The panels are arranged sideways, adjacent and frontally to other panels with the same characteristics. After the panels have been positioned, the adjacent panels are secured with metal sheeting and the front panels are secured with spacers. On the other hand, the adjacent panels are aligned with an aligner connected to the panels with "J" screws and adjustment nuts attached to the screws. On the other hand, the corner piece is an L-profile having holes on its flat faces aligning with the panel perforations, the corner piece being connected to the panel by means of pin-wedge pins. Also, the system includes a profile with welded pins allowing the union of two perpendicular panels.

However, the possible setups of the formwork system do not permit the formation of coffers for the setting of reticular slabs. In addition, aligners must be used for the panels to form a flat wall, which increases the weight of the formwork system. On the other hand, although the spacers prevent the plates from moving outwards, due to the pressure exerted by the concrete, they do not prevent the plates from moving towards the concrete when the nuts are tightened, which would change the thickness of the structural element to be hardened.

Therefore, it is understood that prior art does not disclose a formwork mechanism easy to install, transport and handle, and that adapts to molding and setting of reticular slabs.

BRIEF DESCRIPTION OF THE INVENTION

The present invention corresponds to a formwork mechanism for casting and molding concrete, comprising a coffer having a sheet and four plates arranged around the perimeter of the sheet. Each plate has holes arranged on its front face. Also, the formwork mechanism includes a structural element, connected to one of the plates by fixing means. On the other hand, the structural element has lateral perforations aligned with the holes of one of the coffer plates. Fixing means pass through the holes and side perforations. The structural element can be a beam, a three or four-beam T, and combinations thereof. On the other hand, using various coffers interconnected with structural elements, formworks are constructed for casting flat reticular slabs, and also for curved reticular slabs with greater slab thickness near the beams supporting the slabs in comparison to the span of the slabs.

Figure 8:
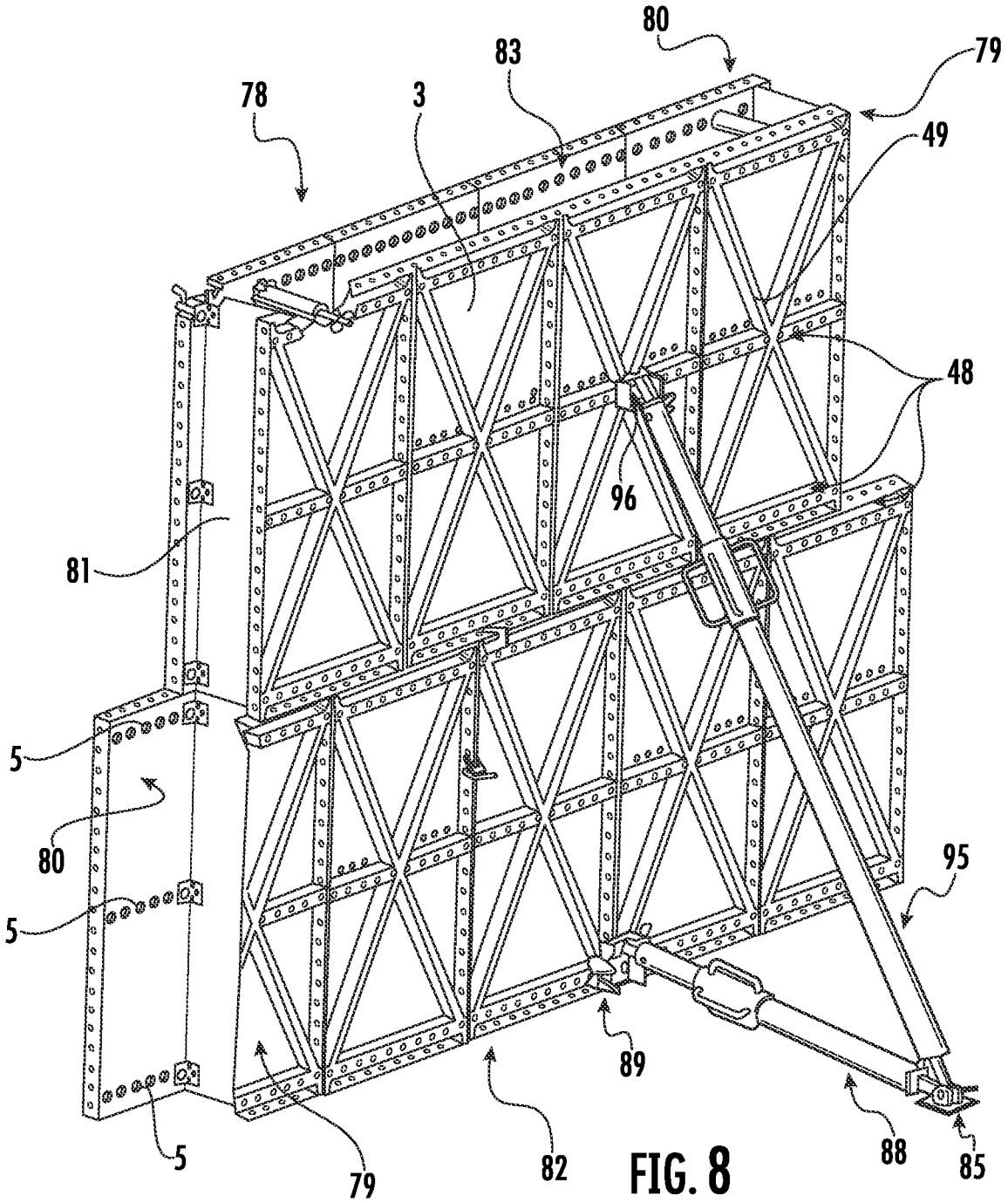

The FIG. 8 corresponds to an isometric view of a wall formwork conformed with coffer plates.

Figure 9A:
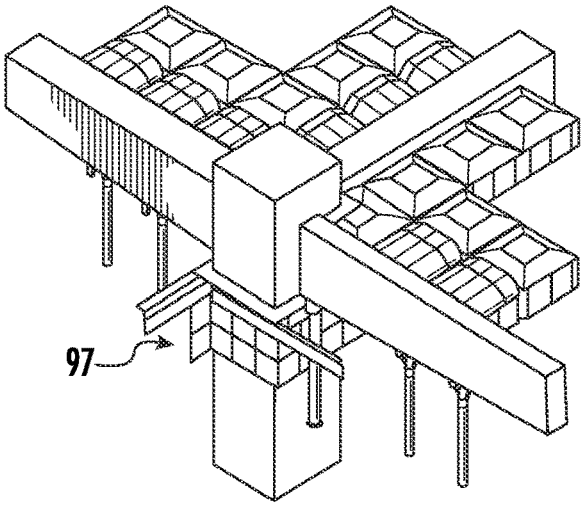

FIG. 9A corresponds to a cut-off view of a curved panel form to give continuity to the curved hanging beam.

Figure 9B:
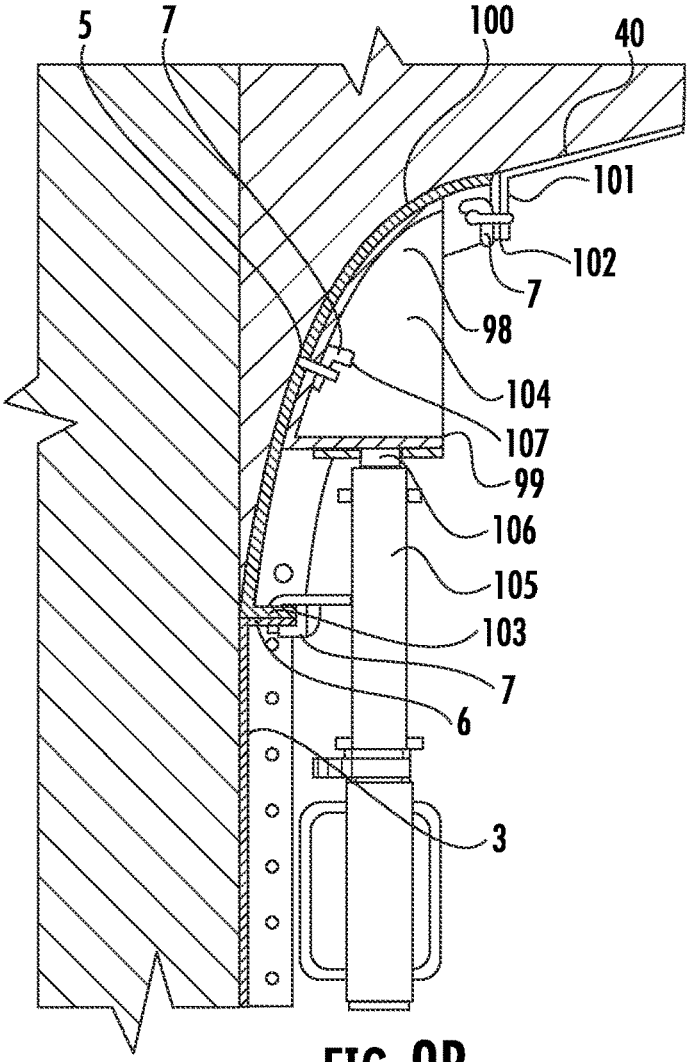

FIG. 9B corresponds to a cross-section view of a portion of the embodiment represented in FIG. 9A.

Figure 10A:
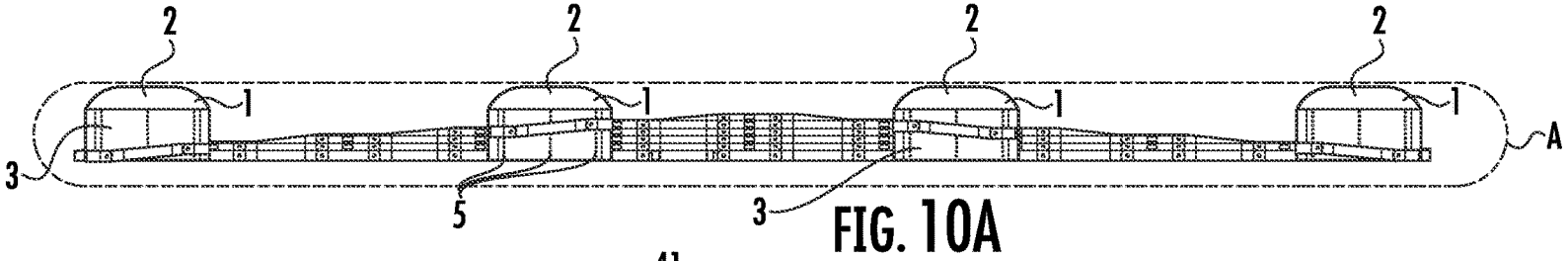

FIG. 10A corresponds to a side view of one embodiment of a formwork mechanism in the present invention that includes structural elements with joists coupled by means of an articulation.

Figure 10B:
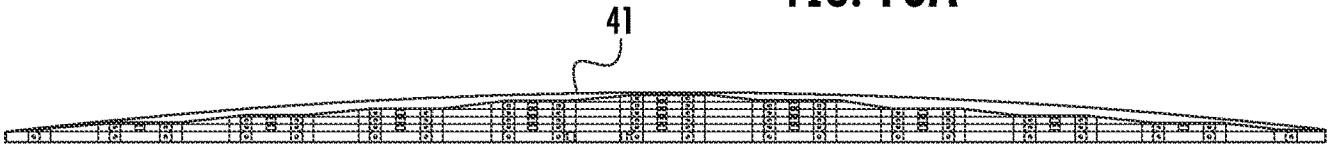

FIG. 10B corresponds to a side view of another embodiment of a formwork mechanism according to the present invention with structural elements with joists coupled by means of an articulation.

Figure 10D:
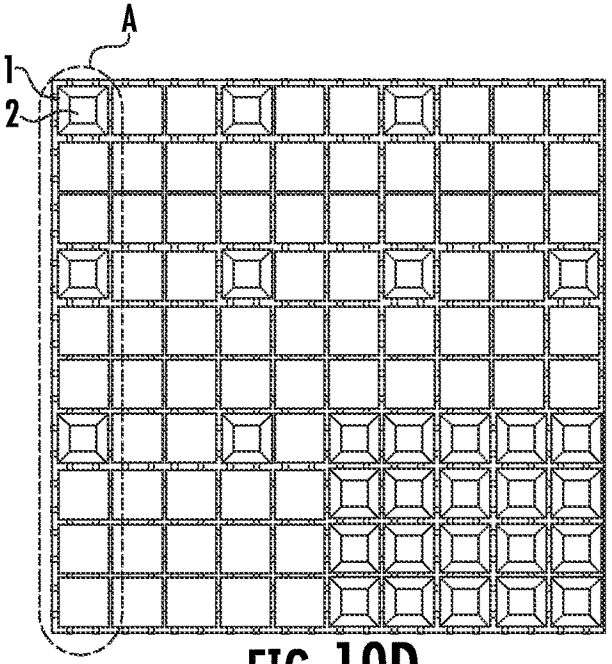
Figure 10C:
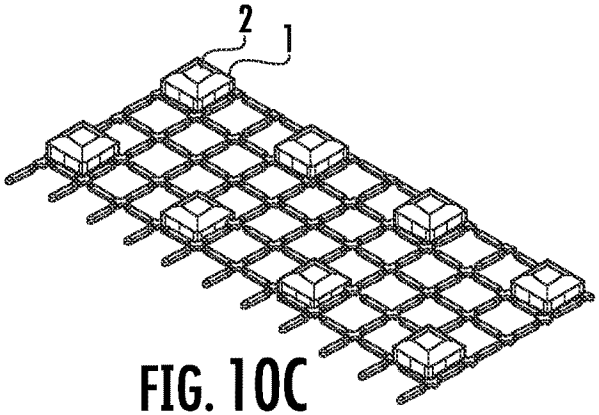

FIG. 10C corresponds to a perspective view of a further embodiment of a formwork mechanism according to the present invention with structural elements with joists coupled by means of an articulation.

FIG. 10D corresponds to a top view of a further embodiment of a formwork mechanism according to the present invention with structural elements with joists coupled by means of an articulation.

Figure 10E:
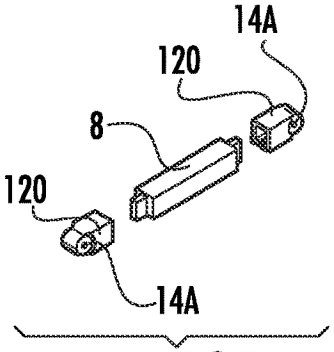

FIG. 10E corresponds to a perspective, exploded view of one embodiment of a beam and joints according to the formwork mechanism of the present invention.

Figure 11I:
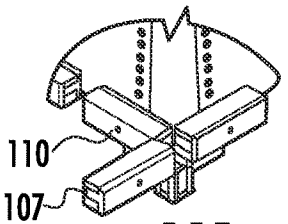
Figure 11J:
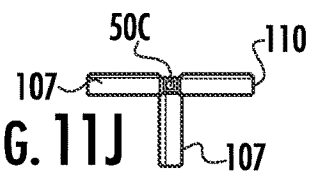
Figure 11K:
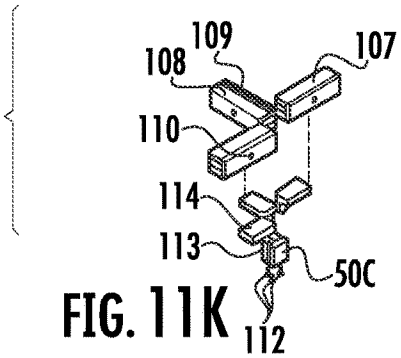
Figure 11F:
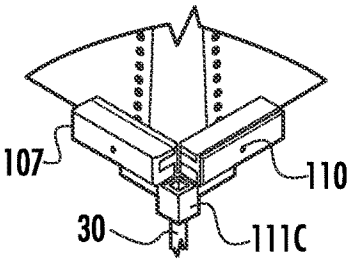
Figure 11G:
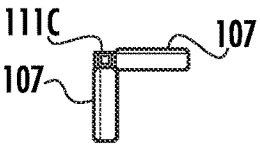
Figure 11H:
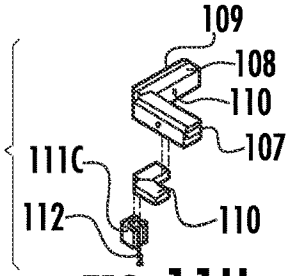
Figure 11C:
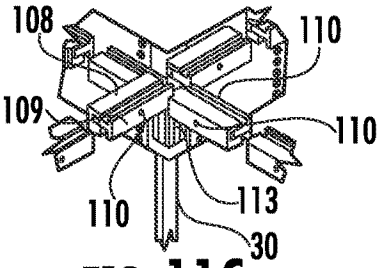
Figure 11D:
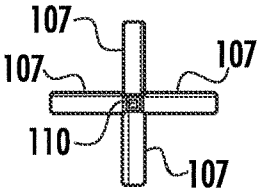
Figure 11E:
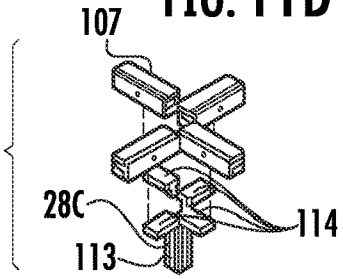
Figure 11B:
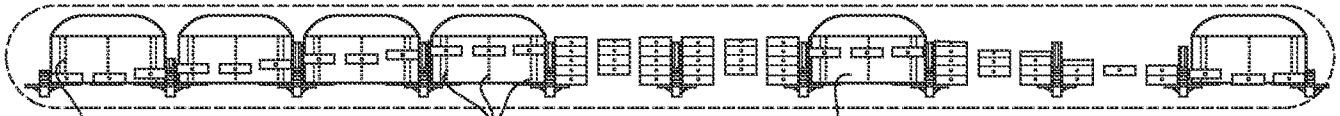
Figure 11A:
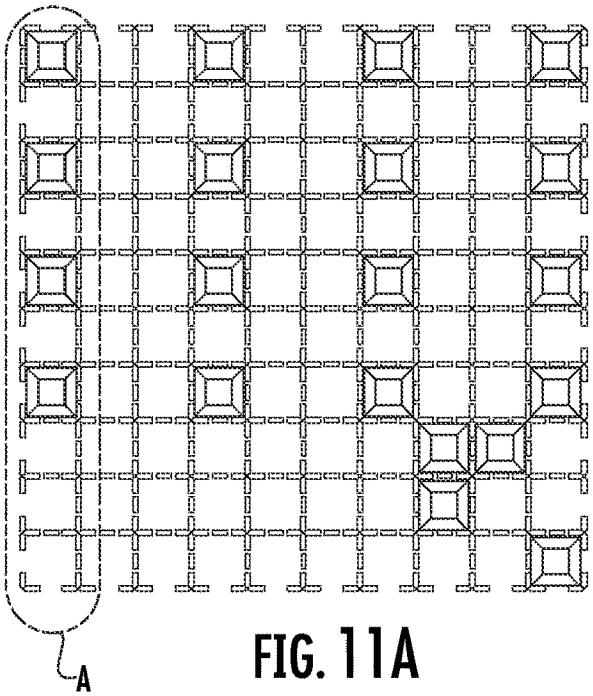

FIG. 11A corresponds to a top view of one embodiment of a formwork mechanism of the present invention that includes structural elements, load supports, beams, Ls, Ts and slidable shelf brackets.

FIG. 11B corresponds to a side view of the embodiment as represented in FIG. 11A.

FIG. 11C corresponds to a perspective view of a portion of one embodiment of a formwork mechanism according to the present invention.

FIG. 11D corresponds to a top view of a portion of one embodiment of a formwork mechanism according to the present invention comprising an intersection of four load supports.

FIG. 11E corresponds to a perspective partially exploded view of a portion of one embodiment of a formwork mechanism according to the present invention comprising an intersection of four load supports with brackets and an adjustable guide.

FIG. 11F corresponds to a perspective view of a portion of one embodiment of a formwork mechanism according to the present invention comprising an intersection of two load supports.

FIG. 11G corresponds to a top view of a portion of another embodiment of a formwork mechanism according to the present invention comprising an intersection of two load supports.

FIG. 11H corresponds to a perspective, partially exploded view of a portion of a further embodiment of a formwork mechanism according to the present invention comprising two load supports a support through hole and a support screw.

FIG. 11I corresponds to a perspective view of a portion of one embodiment according to the present invention comprising an intersection of three load supports.

FIG. 11J corresponds to a top view of a portion of another embodiment according to the present invention comprising an intersection of three load supports.

FIG. 11K corresponds to a perspective, partially exploded view of a portion of a further embodiment of a formwork mechanism according to the present invention comprising three load supports a support through hole and a support screw.

Figure 12D:
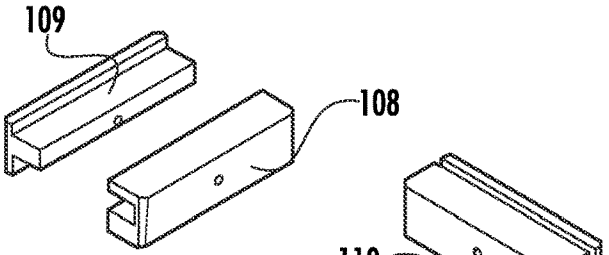
Figure 12E:
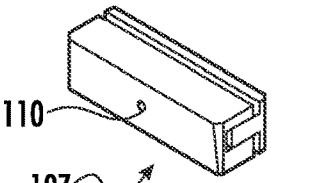
Figure 12C:
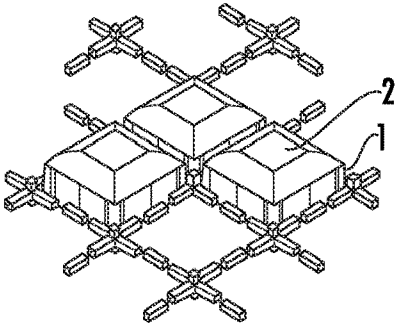
Figure 12F:
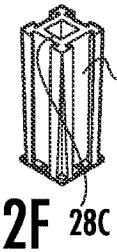
Figure 12J:
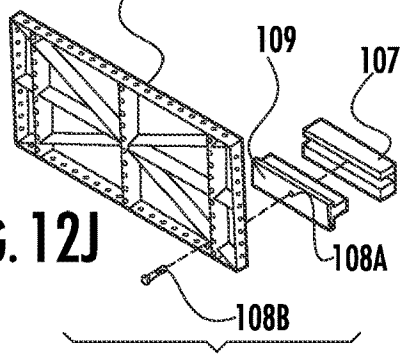
Figure 12B:
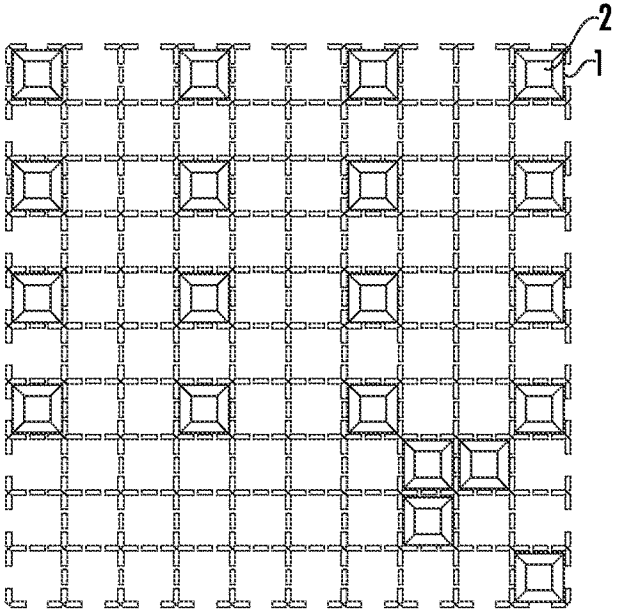
Figure 12I:
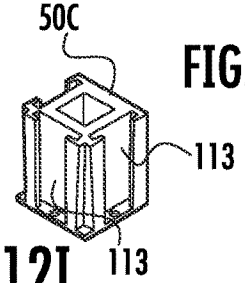
Figure 12H:
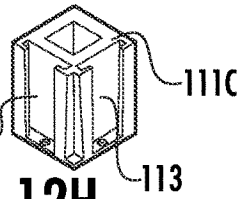
Figure 12G:
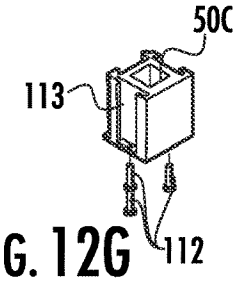
Figure 12A:
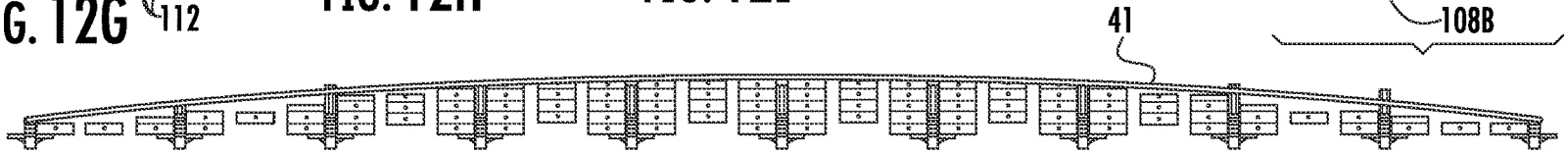

FIG. 12A corresponds to a side view of one embodiment of a formwork mechanism of the present invention that includes structural elements, load supports, beams, Ls, Ts and slideable shelf brackets.

FIG. 12B corresponds to a top view of another embodiment of a formwork mechanism of the present invention that includes structural elements, load supports, beams, Ls, Ts and slideable shelf brackets.

FIG. 12C corresponds to a perspective view of yet another embodiment of a formwork mechanism of the present invention.

FIG. 12D corresponds to a perspective view of one embodiment of a male profile and a female profile of a formwork mechanism according to the present invention.

FIG. 12E corresponds to a perspective view of one embodiment of a joined male profile and female profile of a formwork mechanism according to the present invention.

FIG. 12F corresponds to a perspective view of a portion of one embodiment of an adjustable guide of the formwork mechanism according to the present invention.

FIG. 12G corresponds to a perspective view of a portion of another embodiment of an adjustable guide of the formwork mechanism according to the present invention.

FIG. 12H corresponds to a perspective view of a portion of yet another embodiment of an adjustable guide of the formwork mechanism according to the present invention.

FIG. 12I corresponds to a perspective view of a portion of an even further embodiment of an adjustable guide of the formwork mechanism according to the present invention.

FIG. 12J corresponds to a perspective view of a perspective, partially exploded view of a portion of one embodiment of a male and a female profile being connected to a sheet.

Figure 13A:
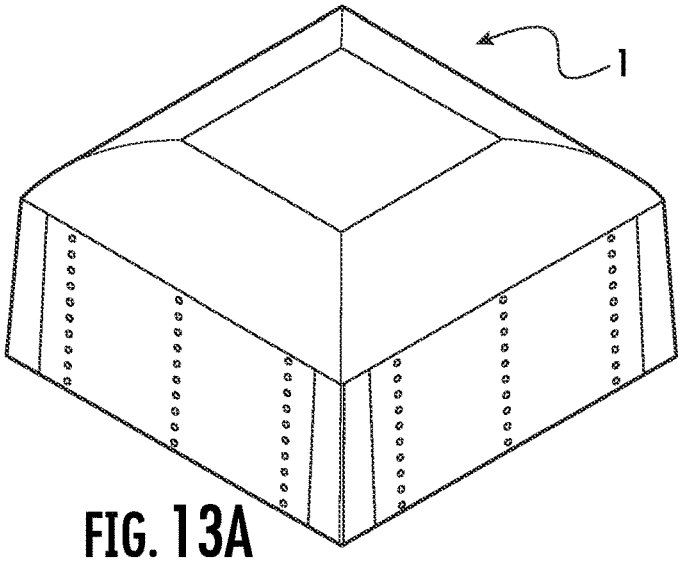

FIG. 13A corresponds to an embodiment of a coffer of the present invention that has a sheet with orthogonal and diagonal reinforcing profiles.

Figure 13B:
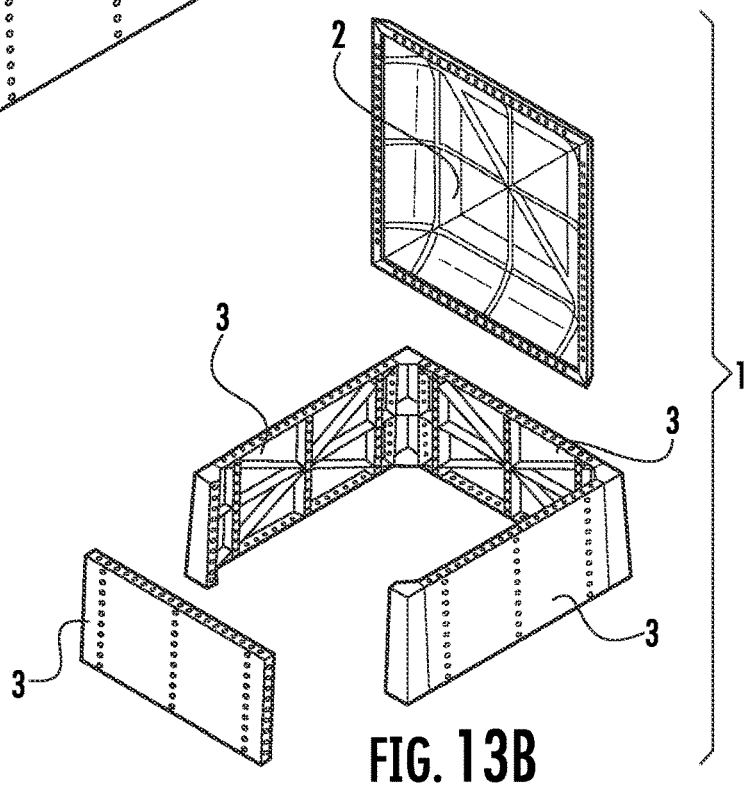

FIG. 13B corresponds to a perspective, partially exploded view of one embodiment of a coffer according to the formwork of the present invention.

Figure 13C:
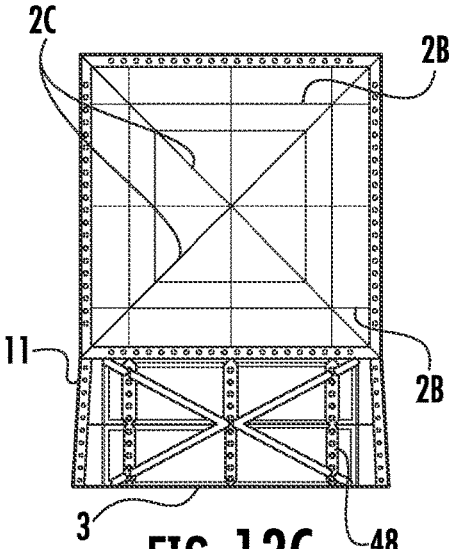

FIG. 13C corresponds to a side view of one embodiment of a coffer according to the formwork of the present invention.

Figure 14A:
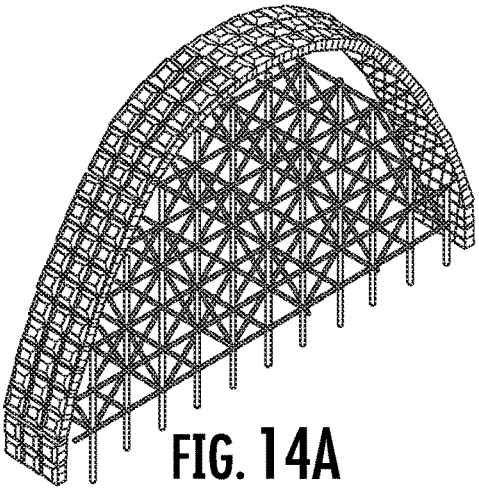

FIG. 14A corresponds to a perspective view of one embodiment of the formwork mechanism in the present invention, which allows parabolic slabs to be formed.

Figure 14B:
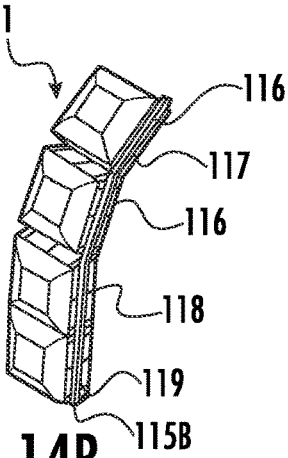

FIG. 14B corresponds to a perspective view portion of one embodiment of the formwork mechanism according to the present invention.

Figure 14C:
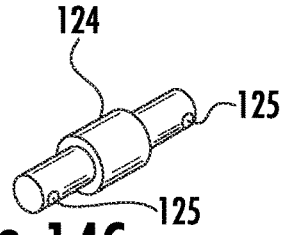

FIG. 14C corresponds to one embodiment of an adjustable screw of the formwork mechanism according to the present invention.

Figure 14D:
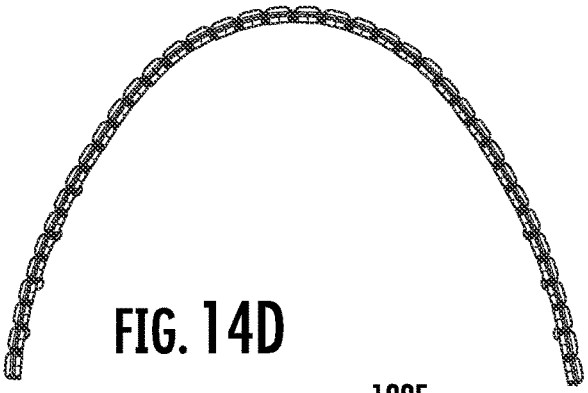

FIG. 14D corresponds to a side view of a portion of one embodiment of the formwork mechanism according to the present invention.

Figure 14E:
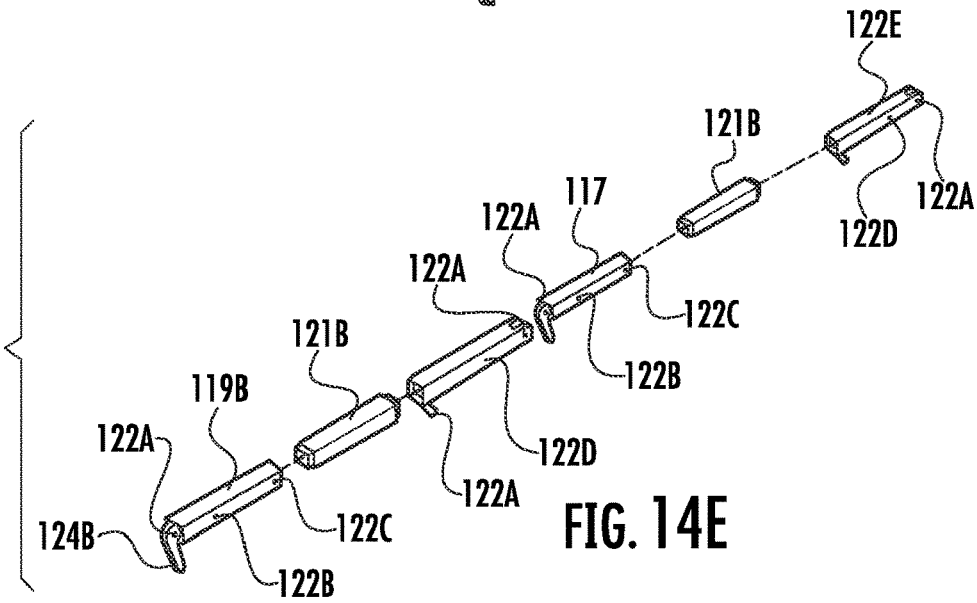

FIG. 14E corresponds to a perspective, exploded view of an assembly of configuration parts according to the formwork mechanism according to the present invention.

DETAILED DESCRIPTION OF THE INVENTION

With initial reference to FIGS. 1A-14E, the present invention corresponds to a formwork mechanism (hereinafter, mechanism) for casting and molding concrete.

It shall be understood in the present invention that formwork is mold for a piece of curable material, particularly concrete, and reinforced concrete. The formwork is made up of a plurality of elements defining the geometry of the curable material piece. Formwork may be a negative or positive mold, over which liquid curable material is poured, which fills the formwork and cures in the formwork. Pieces of curable material may be slabs, reticular slabs, variable cross-section reticular slabs, folded slabs, walls, columns, porticoes and combinations thereof.

The mechanism comprises:

a coffer (1) made up of a sheet (2) and a plate (3) arranged around the perimeter of the sheet (2), the plate (3) has holes (5) arranged on its front face; and a structural element (4) connected to the plate (3) by fixing means (7), the structural element (4), has lateral perforations (9) that are aligned with the holes (5) of the coffer (1) plate (3);

where the fixing means (7) pass through the holes (5) and the side perforations (9).

In an invention embodiment, the sheet (2) has a circular base, and the plate (3) is a plate bent into a cylindrical or conical shape. In this way, it is possible to assemble formworks for reticular slabs with cylindrical, or truncated conical reticles.

In an invention embodiment, the sheet (2) is convex and has a circular base. The sheet (2) can be a paraboloid or a hemisphere. This geometry allows the coffer (1) to be easily removed from the slab when the concrete is cured.

In an invention embodiment, the coffer (1) consists of a sheet (2) and two plates (3) arranged on the sheet perimeter (2), the plate (3) has holes (5) arranged on its front face.

The sheet (2) may have a truncated circular base, ellipsoidal, circular or a combination thereof.

In an invention embodiment, the coffer (1) consists of a sheet (2) and three plates (3) arranged on the sheet perimeter (2), the plate (3) has holes (5) arranged on its front face. The sheet (2) has a triangular base.

Within the triangular bases, there are forms of right triangles, isosceles, equilaterals, scalenes, acutangles, obtusangles.

In an invention embodiment, the sheet (2) has a base shaped like an equilateral triangle. In this way, the three plates (3) are of equal dimensions.

In an invention embodiment, the sheet (2) has an isosceles triangle-shaped base. In this way, there are two plates (3) with the same dimensions, and one plate (3) with a different length.

In an invention embodiment, the sheet (2) has a base shaped like a right-angled triangle. In this way, triangular reticles may be formed with a coffer (1), or rectangular reticles may be formed by connecting the plates (3) that form the hypotenuses of the sheet bases (2) of two coffers (1).

Figure 1A:
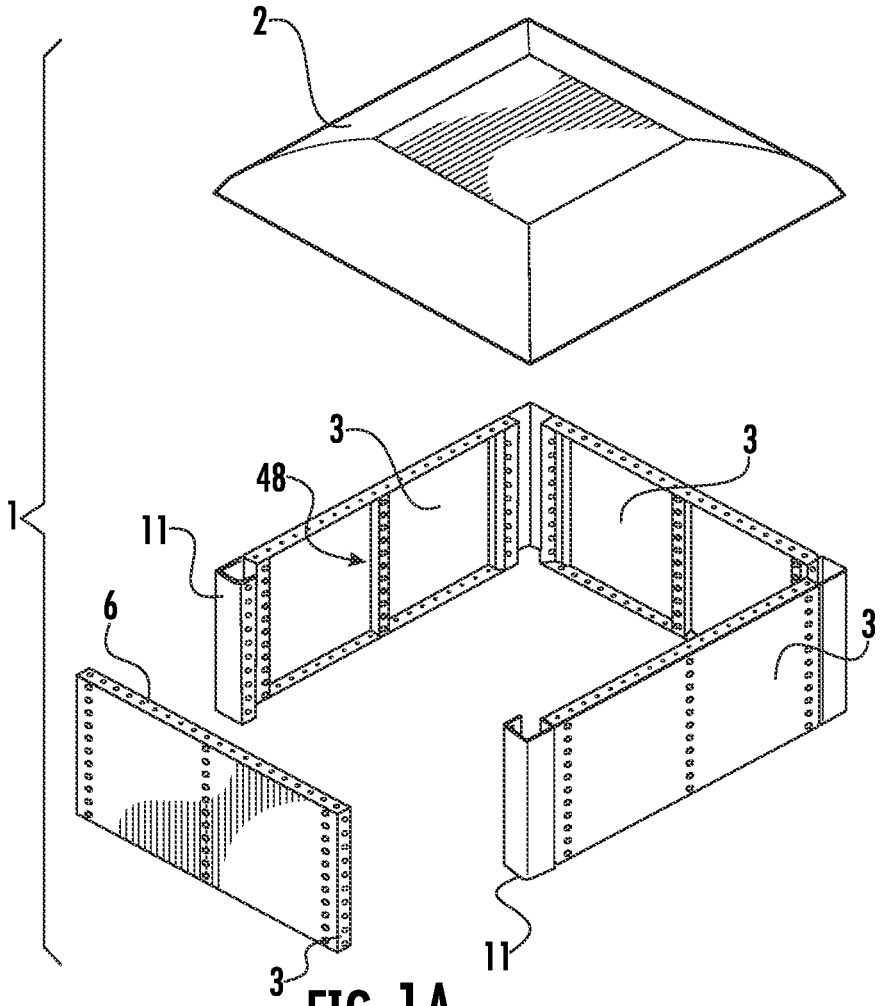
FIG. 1A corresponds to an exploded view of a coffer embodiment of a formwork mechanism.
Figure 1B:
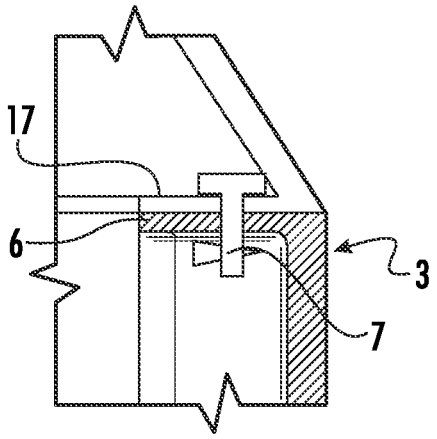
FIG. 1B corresponds to a section view of a portion of one embodiment of a sheet according to the formwork mechanism.
Figure 2:
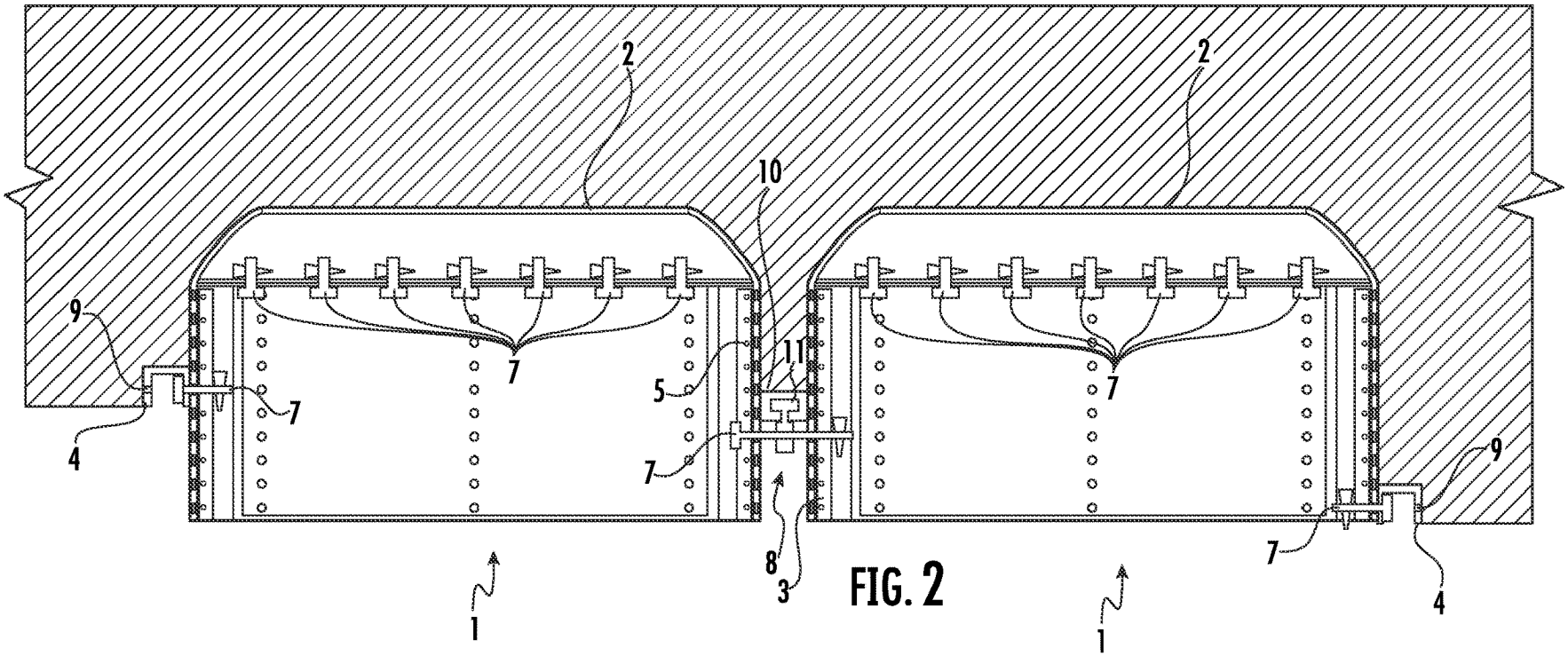
FIG. 2 corresponds to a cross-sectional view of a hardened reticular slab with coffers connected to each other with structural elements, in a coffer embodiment of a formwork mechanism.

Referring to FIG. 1A and FIG. 2, in an invention embodiment, the mechanism comprises:

a coffer (1) with a sheet (2) and four plates (3) arranged around the perimeter of the sheet (2), each plate (3) has holes (5) arranged on its front face, and a structural element (4) connected to one of the plates (3) with fixing means (7), the structural element (4), has lateral perforations (9) which are aligned with the holes (5) of one of the coffer (1) plates (3), where the fixing means (7) pass through the holes (5) and the side perforations (9).

In an invention embodiment, the coffer (1) is a monolithic body formed by the four plates (3) and the sheet (2). The monolithic body may be of metal, wood, or plastic (e.g. polyester resins, vinyl ester, epoxy, phenolic, acrylic) reinforced with fibers (e.g. glass, carbon, aramid).

In an invention embodiment, the coffer (1) is of plastic reinforced with fiberglass. The coffer (1) may be manufactured by spraying, hand lay-up, resin infusion processes, resin transfer molding (RTM), reaction injection molding (RIM), vacuum-assisted resin transfer molding (VARTM), thermoforming, pultrusion, and combinations thereof.

In an invention embodiment, the plates (3) and sheet (2) are panels composed of at least one layer of fiberglass and one layer of core stiffener. Preferably, the stiffening core layer is covered on both sides with a fiberglass layer impregnated with resin.

The stiffening material is selected from nonwovens with expanded micro spheres, balsa wood, polyurethane foams, polyvinyl chloride (PVC), polyethylene, polyethersulsons, honeycombs and combinations thereof.

In an invention embodiment, the coffer (1) has a plurality of layers ranging from the outer surface that would be in contact with the concrete, to the inner surface that does not come into contact with the concrete at the time of casting and molding it. The outer surface consists of a protective coating, e.g. polyester resin or vinyl ester gel coat; polyurethane-based paints, epoxy paint and combinations thereof.

Below the protective coating layer there is a first layer of fiber mat, preferably fiberglass, which is impregnated with resin, preferably polyester resin. Below the first layer of fiber mat impregnated with resin, there is a layer of stiffening core. A second layer of fiber impregnated with resin is placed beneath the core layer.

In an invention embodiment, the holes (5) of the plate (3) are made on the coffer (1) after forming the monolithic body. The holes (5) may be drilled or punched. The holes (5) serve to connect the plates (3) to other parts of the formwork mechanism in the present invention, such as the structural elements (4).

In an invention embodiment, each plate (3) has two vertical rows of holes (5).

In an invention embodiment, each plate (3) has three vertical rows of holes (5).

The holes (5) may be vertically separated from each other, a distance between 1 cm and 15 cm. Also, they may be vertically separated from each other a distance between 1 cm and 2 cm, between 2 cm and 4 cm, between 5 cm and 6 cm, between 7 cm and 8 cm, between 9 cm and 10 cm, or between 11 cm and 15 cm.

In an invention embodiment, each plate (3) has a stiffening profile (48) located on its back side. The stiffening profile (48) increases the stiffness of the plate (3). This is important, since the quality, finishes, and geometric and dimensional tolerances of the concrete pieces that set in formworks made with these plates (3) depend on the dimensional stability of the plates (3).

Figure 1C:
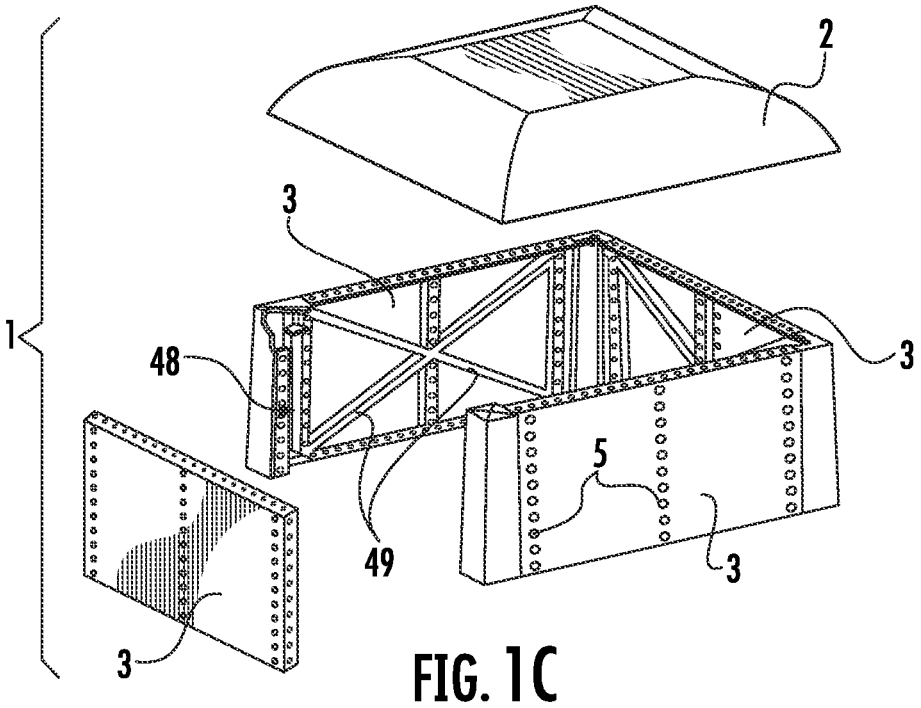
FIG. 1C corresponds to an exploded view of an inclined coffer embodiment of a formwork mechanism.
Figure 1D:
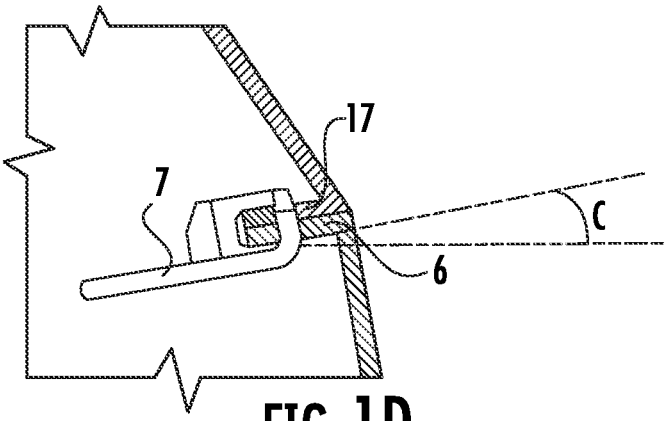
FIG. 1D corresponds to a section view of a portion of one embodiment of a sheet according to the formwork mechanism.

Referring to FIG. 1C, in an invention embodiment, each plate (3) has two stiffening ribs (49), each stiffening rib (49) extends from an upper corner of the plate (3) to the opposite lower corner, thus, the stiffening ribs (49) form a cross that gives greater rigidity to the plate (3).

Referring to FIG. 1A and FIG. 1C, in an invention embodiment, each plate (3) has three vertical stiffening profiles (48) located on its rear face. Preferably, the stiffening profiles (48) have a plurality of perforations aligning with the holes (5) of the plate (3).

In the preferred invention embodiment, the sheet (2) is convex. The sheet (2) has four curved faces, each curved face exits the periphery of the sheet (2) and converges to a flat surface. The flat surface may be square, rectangular, circular, oblong, elite, oval, and combinations thereof.

In an invention embodiment, the sheet (2) is a parabolic vault with four truncations, where each truncation is aligned with a plate (3).

The convex shape of the sheet (2) allows easy removal of the coffer (1) after the concrete is cured. However, if the sheet (2) is flat and rectangular, rounding can be made at the sheet (2) and plates (3) edges to facilitate the coffer removal.

Referring to FIG. 1A, in an invention embodiment, the coffer (1) includes:

punctured tabs (17) located on the sheet periphery (2);

punctured tabs (6) located on each plate periphery (3), where a punctured tab (6) from each plate (3) is connected to a punctured tab (17) from the sheet (2) by fixing means (7); and four corner profiles (11), each corner profile (11) has two perforated tabs (12), each perforated tab (12) is connected to a punctured tab (6) of a plate (3).

The punctured tabs (17) on the sheet (2) allow the sheet (2) to be connected and disconnected to the punctured tabs (6) on the plates (3). The punctured tabs (17) are oriented in such a way their holes are in a vertical position inside the coffer (1).

On the other hand, the punctured tabs (6) of the plates (3) are oriented towards the inside of the coffer (1), so the holes of the punctured tabs (6) point towards the lateral, upper and lower faces of each plate (3).

The punctured tabs (6) may be of the same material as the plates (3), or they may be of a different material. If the plates (3) and the punctured tabs (6) are of the same material, they may be manufactured by the same manufacturing process, e.g. sheet bending, welding (e.g. SMAW, GMAW, GTAW, FCAW, and other methods accepted by the American Welding Society), rotomolding, 3D printing, injection, thermoforming, stamping, drawing, milling, and combinations thereof.

If the plates (3) and the punctured tabs (6) are made of different materials, they may be joined together with fixing means (7), such as screws, rivets, bolts, shelf brackets, chemical welding, dovetail joints, and combinations thereof.

Similarly, the punctured tabs (17) may be of the same material as the sheet (2). If the plates (3) and the punctured tabs (6) are of the same material, they may be manufactured by the same manufacturing process, e.g. sheet bending, welding (e.g. SMAW, GMAW, GTAW, FCAW, and other methods accepted by the American Welding Society), rotomolding, 3D printing, injection, thermoforming, stamping, drawing, milling, and combinations thereof.

If the sheet (2) and the punctured tabs (17) are made of different materials, they may be joined together with fixing means (7), such as screws, rivets, bolts, shelf brackets, chemical welding, dovetail joints, and combinations thereof.

In an invention embodiment, the sheet (2) punctured tabs (17) are oriented horizontally. This is convenient for connecting the plates (3) to the sheet (2) so the plates (3) are vertically oriented, so a straight coffer may be configured, which is explained below.

Referring to FIG. 1C, in an invention embodiment, the sheet (2) punctured tabs (17) are oriented in an inclined manner with respect to the horizontal. This allows the plates (3) to be inclined with respect to the vertical, in this way, an inclined coffer may be configured, which will be explained later.

The fixing means (7) are selected from screws, bolts, rivets, pin wedges, plates, self-drilling screws, and combinations thereof.

In an invention embodiment, the fixing means (7) are wedge-pins and small plates. Wedge pins are easy to install on site, as it is only necessary to use a mallet or hammers for the joint, in addition, they are less susceptible to damage when contaminated with concrete.

However, in confined space conditions, wedge-pins may be difficult to install, for example, to connect plates (3) to corner profiles (11), when plates (3) have stiffening profiles (48) near their punctured side tabs (6). In order to overcome the inconvenience of wedge-pins in confined spaces, the fixing means (7) may be small plates, which are easy to install.

The corner profiles (11) are used to interconnect the plates (3) and to change the inclination angle C of the plates (3) with respect to the sheet (2). This angle C may be between 90° and 150°.

In an invention embodiment, corner profiles (11) are straight, and are used to form a straight coffer (1).

In this invention, straight shall be understood as an element having at least two contiguous faces forming a right angle, where the contiguous faces have the same length at their upper and lower edges.

Referring to FIG. 1C, in an invention embodiment, corner profiles (11) are inclined. It will be understood in the present invention that an inclined corner profile (11) is a corner profile (11) with two contiguous faces forming a greater than 90°, where the contiguous faces have a shorter length in their upper edge than in their lower edge.

In an invention embodiment, the coffer (1) is inclined and has four corner profiles (11) inclined, which cause the plates (3) to form an angle C with respect to the horizontal, which may be between 91° and 115°. Also, the angle C may be between 91° and 93°, between 94° and 95°, between 96° and 97°, between 97° and 99°, between 100° and 105°, between 105° and 108°, between 109° and 112°, or between 112° and 115°.

In an invention embodiment, angle C, and the angle forming the contiguous faces of the corner profile (11) is 90.14°.

It will be understood from the present invention that the inclined coffer (1) is a coffer with inclined corner profiles (11). The inclined coffer has its plates (3) inclined with respect to the vertical, in this way, the inclined coffer (1) is left with an exit angle facilitating its extraction from the concrete, when it is already cured.

As stated above, the sheet (2) punctured tabs (17) are oriented at an angle with respect to the horizontal, in order to allow the plates (3) to be inclined, and the punctured tabs (17 and 6) to secure each other. These punctured tabs (17 and 6) are secured with fixing means (7), e.g. small plates, or wedge pins.

In an invention embodiment, corner profiles (11) have reinforcing plates, an upper reinforcing plate located at the upper longitudinal end of the corner profile (11), and a lower reinforcing plate located at the lower longitudinal end of the corner profile (11). Reinforcement plates may be pentagonal with three straight angles. The reinforcement plates improve the rigidity of the corner profiles (11) and therefore improve the rigidity of the coffers (1).

In an invention embodiment, the upper reinforcement plates of the corner profiles (11) have a perforation aligned with one of the perforations of the sheet (2) punctured tabs (17). In this way, a fixing means (7) may be connected securing the corner profiles (11) with the sheet (2).

In an invention embodiment, the coffer (1) is a coffer (1) type L comprising:

a rectangle-shaped lid (53); the lid (53) has a rectangular cut (54) in one of its corners; and L-plates connected to the lid periphery (53);

where each L-plate comprises two panels connected to each other at 90°; each L-plate has at its top edge punctured tabs (17) in which fixing means are inserted (7) securing the L-plates to the lid (53); and where the L-shaped plates form a prismatic surface extending from the lid (53).

The L-type coffer permits the formation of reticles with an L-geometry in reticular slabs. This allows the L-type coffer (1) to be connected to the corners of a structural element that would support the reticular slab, for example, a wall, a pile, a prop or a beam.

In this invention, it will be understood that L-shaped, L-shaped geometry, L-shaped section, L-shaped cross-section and L-shaped type, refer to the geometric features of a part which has a cross-section with at least two sides 90° apart. For example, an L shape is a rectangle with a rectangular cut at one of its vertices, or a prism based on a rectangle with a rectangular cut at one of its vertices.

Figure 1E:
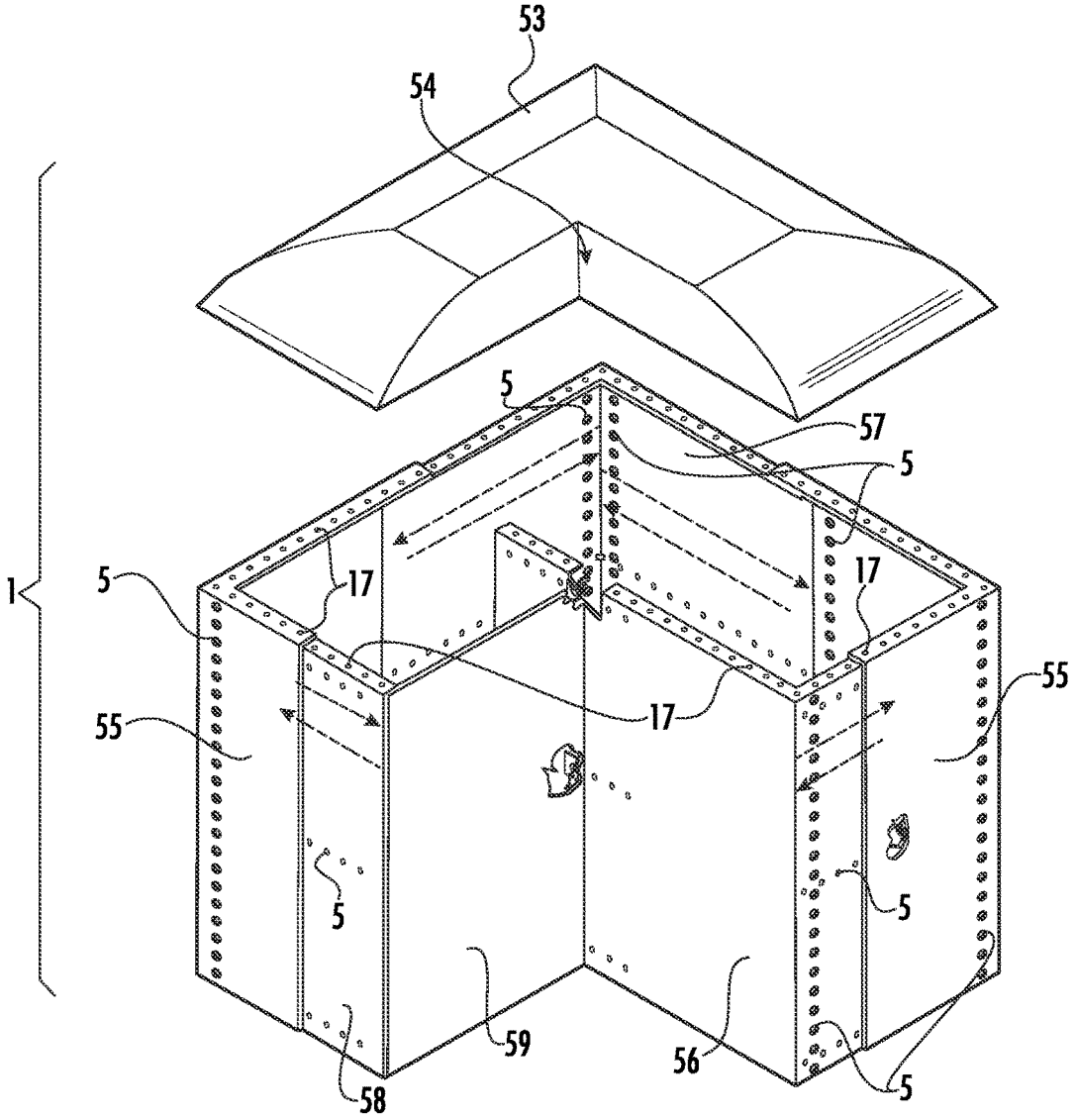
FIG. 1E corresponds to an exploded view of an L-type coffer embodiment of a formwork mechanism.
Figure 1F:
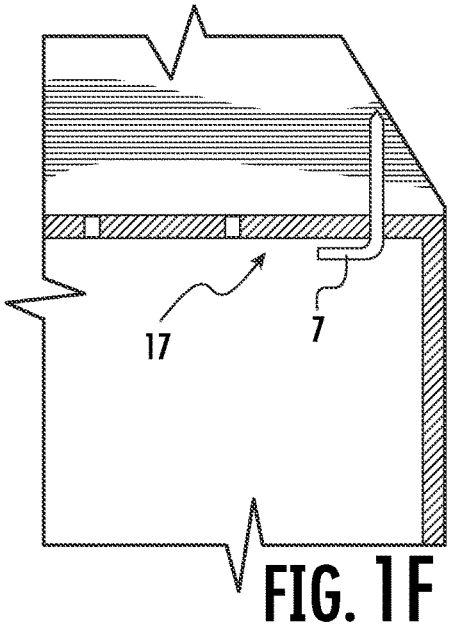
FIG. 1F corresponds to a section view of a portion of one embodiment of a sheet according to the formwork mechanism.

Making reference to FIG. 1E, in an embodiment of the invention, the coffer (1) is an L-type coffer comprising:

a trapezoid-shaped lid or cover (53) with rounded side faces; the lid (53) has a rectangular cut (54) in one of its corners;

two outer L-plates (55) connected to the corners with short bottom edges of the lid (53); and a first inner L-plate (56) connected to one of the rectangular cut lower edges (54) and a second inner L-plate (57) connected to the two outer L-plates (55);

where each L-plate (55), (56) and (57) is made of two panels connected to each other at 90°; each L-plate (55), (56) and (57) has punctured tabs (17) at its top edge;

a first flat plate (58) connected as a slide-on with an outer L-plate (55), first the flat plate (58) has punctured tabs (17); and a second flat plate (59) connected between the first flat plate (58) and an inner L-plate (56).

It will be understood in the present invention that short edges are the lower edges of the cover (53) located next to the rectangular cut (54).

The punctured tabs (17) of the L-plates (55), (56) and (57) are used to connect the L-plates (55), (56) and (57) to the cover (53) with fixing means (7), such as self-drilling screws, nails, self-tapping screws, wedge pins, punches, small plates and combinations thereof.

Referring to FIG. 1E, in an invention embodiment, the fixing means (7) used to connect the L-plates (55), (56) and (57) to the cover (53) are steel punches.

The plates in L (55), (56) and (57) have in their panels holes (5) allowing to adjust the length of the prismatic surface sides, and to connect the L-type coffer (1) to structural elements (4), such as beams (8), crosses (29), and T (50). The holes (5) are arranged in vertical and/or horizontal rows. The horizontal rows allow the length of the prismatic surface sides to be adjusted; on the other hand, the vertical rows serve to adjust the height to which the structural elements are connected (4).

The second flat plate (59) is connected to the inner L-plate (56) by angles (60) which are connected to both elements by fixing means (7). Fixing means (7) may be screws, bolts, self-tapping screws, self-drilling screws, wedge-pins, small plates, and combinations thereof.

Referring to FIG. 1E, in an invention embodiment, the fixing means (7) connecting the angles (60) to the second flat plate (59) and the inner L-plate (56) are self-tapping screws. On the other hand, the second flat plate (59) is a flat panel.

In an invention embodiment, the second flat plate (59) and lid (53) are custom made. This makes it possible to form L-type coffers (1) with different dimensions, which are suitably coupled to the geometry of the load-bearing structural elements, for example, a wall or a concrete column.

The material of the second flat plate (59) and lid (53) is a wear-resistant material, which may be wood (e.g. phenolic wood, MDF, three-layer wood), plastic (e.g. polyester, polyamides, polyurethanes, polycarbonate, polystyrene), plastic (e.g. cured polyester resins, vinyl ester, epoxies) reinforced with fibers (e.g. glass, aramid, carbon, polyester), and combinations thereof.

In an invention embodiment, the second flat plate (59) and the lid (53) are made of the same material.

In an embodiment of invention, the coffer (1) is a L-type coffer (1) comprising:

a trapezoid-shaped lid (53) with rounded side faces; the lid (53) has a rectangular cut (54) in one of its corners; the lid (53) has punctured tabs (17) arranged at its six lower edges;

six plates (3); each plate (3) has punctured tabs (6) on its periphery and a plurality of holes (5) located on its front face; where each plate (3) is connected to a punctured tab (17) of the sheet (2) and, six corner profiles (11), each corner profile (11) has two perforated tabs (12), each perforated tab (12) is connected to a punctured tab (6) of a plate (3).

In an invention embodiment, the lid (53) is a convex sheet (2) with rectangular cut. The lid (53) has two vertically oriented flat faces, which are located on the two edges of the rectangular cut. These flat faces contact the corner of a load-bearing structural element, for example, a wall or a concrete column. Also, the flat faces may contact a formwork section to set the load structural element; in this way, the concrete fills the formwork of the load structural element and covers the L-type coffer (1), generating a monolithic union.

The plates (3) of the L-type coffers (1) may be like the plates (3) of the straight coffers (1). Also, the plates (3) of the L-type coffers (1) may be selected between planks, wooden plates (triplex, MDF, phenolic woods, wood for construction, wood for formworks, and combinations thereof); plastic plates and combinations thereof.

In an invention embodiment, the plates (3) of the L-type coffers (1) are smooth panels or plates, without perforations or holes, made of wood or plastic.

Smooth plates or panels have at their corners L-shaped angles, which are installed to these plates and panels with fixing means (7), e.g. nails, self-drilling screws, self-tapping, bolts and combinations thereof. On the other hand, the L-angles are connected to the perforated tabs (6) of the plates (3), and to the sheet (2) punctured tabs (17), also with fixing means (7).

In an embodiment of invention, the L-type coffer (1) is a monolithic body formed by a convex sheet (2) with a rectangular truncation in one of its corners and the six plates (3).

The monolithic body may be metal, wood, or plastic (e.g. polyester resins, vinyl ester, epoxy, phenolic, acrylic) reinforced with fibers (e.g. glass, carbon, aramid).

In an invention embodiment, the coffer (1) is of plastic reinforced with fiberglass. The coffer (1) may be manufactured by spraying, hand lay-up, resin infusion processes, resin transfer molding (RTM), reaction injection molding (RIM), vacuum-assisted resin transfer molding (VARTM), thermoforming, pultrusion, and combinations thereof.

In an invention embodiment, the coffer (1) has a plurality of layers ranging from the outer surface that would be in contact with the concrete, to the inner surface that does not come into contact with the concrete at the time of casting and molding it. The outer surface consists of a protective coating, e.g. polyester resin or vinyl ester gel coat; polyurethane-based paints, epoxy paint and combinations thereof.

Below the protective coating layer, there is a first layer of fiber mat, preferably fiberglass, which is impregnated with resin, preferably polyester resin. Below the first layer of fiber mat impregnated with resin, there is a layer of stiffening core. A second layer of fiber impregnated with resin is placed beneath the core layer.

In an invention embodiment, the holes (5) of the plate (3) are made on the coffer (1) after forming the monolithic body. The holes (5) may be drilled or punctured. The holes (5) serve to connect the plates (3) to other parts of the formwork mechanism of the present invention, such as the structural elements (4).

Figures 1G, 1H, 1I:
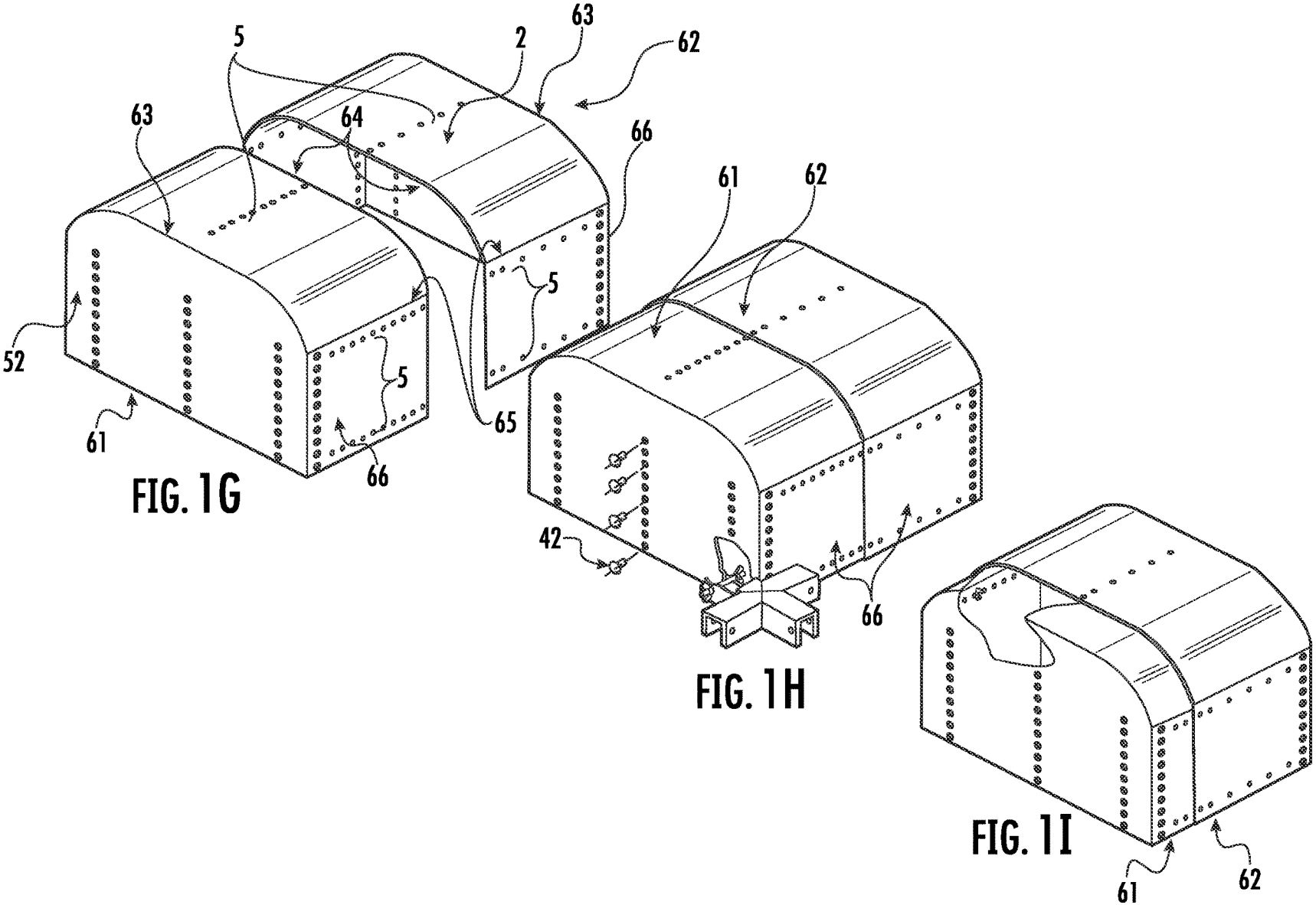
FIG. 1G corresponds to a perspective, exploded view of a sliding coffer embodiment of a formwork mechanism.
FIG. 1H corresponds to a perspective, view of a portion of another embodiment of a sliding coffer of a formwork mechanism.
FIG. 1I corresponds to a perspective view of a portion of yet another embodiment of a sliding coffer of a formwork mechanism.

Referring to FIG. 1G-1I, in an invention embodiment, the coffer (1) is a sliding coffer (1) comprising:

- a first cap (61) and a second cap (62) which is housed inside the first cap (61) in a sliding manner; each cap has:
  - one sheet (2) oriented horizontally, with one rear edge (63), one front edge (64), and two side edges (65);
  - a rear plate (52) connected to the rear edge of the sheet (2); and
  - two side plates (66) connected to the side edges of the sheet (2), and connected to the rear plate (52);
- where the front edge of the sheet (2) and the side plates (65) form a hollow front face; and,
- where the hollow front face of the first cap (61) is inserted into the hollow front face of the second cap (62).

The side plates (3) have at least two rows of holes (5) parallel to each other; one row is located near the sheet (2), and the other row is located near the bottom edge of the plate (3). On the other hand, each sheet (2) has a row of holes (5).

The holes (5) of the first cap (61) are aligned with the holes (5) of the second cap (62), and secured with fixing means (7), which are preferably pin-knives. The length of the sliding coffer (1) is adjusted with the rows of holes (5) of the first cap (61) and the second cap (62). This is convenient to form reticular slabs, in which it is sought to have different lengths of nerve for the reticles.

In an invention embodiment, the sheet (2) is convex, and has its front and rear edges of semi-oblong shape. This allows the sliding coffer (1) to have rounded upper side corners, which facilitates the demolding process when concrete is cured on top of the sliding coffer (1).

On the other hand, to prevent concrete from being inserted between the hollow front faces of the sliding coffers (1) during concrete setting, a massif is placed to cover the front edge of the second cap (62) and sits on the sheet (2) and side plates (66) of the first cap (61).

In the previous coffer embodiments (1), in order to prevent concrete from being inserted into the holes (5) that have no fixing means (7) during concrete setting, plugs (42) are connected to these holes (5). The plugs (42) may be plastic, metal, or rubber.

In a form of invention, the coffers (1) are lined with a protective material, for example plastic, in order to cover the holes (5) and prevent concrete from entering them. Additionally, the protective coating protects the coffers (1) when they are removed when the concrete is cured.

In an invention embodiment, plates (3), sheet (2), punctured tabs (6) and (17), and corner profiles (11) may be manufactured by processes such as sheet bending, soldering (e.g., SMAW, GMAW, GTAW, FCAW, and other methods accepted by the American Welding Society), chemical welding (e.g. epoxy adhesives, methacrylates, acrylics, and combinations thereof), rotomolding, 3D printing, injection, thermoforming, stamping, embossing, milling, and combinations thereof.

Referring to FIG. 2, in an invention embodiment, the structural element (4) is a beam with lateral perforations (9) arranged on its lateral faces. The lateral perforations (9) are aligned with the holes (5) of the plates (3); after aligning the holes (5) and the lateral perforations (9) a fixing means is inserted through the beam and plate (3). Preferably, the fixing means (7) is a pin wedge; however, they can also be screws or bolts.

On the other hand, the structural elements (4) include at least one connection port located on its underside. In the connection port of the structural elements (4) the upper end of a block, or parallel that transmits the load of the structural elements (4), and of the elements connected to them (e.g. coffers (1), plates, beams, forms, etc.) is connected.

In an invention embodiment, the connection port is a vertical pin inserted into the cue.

In an invention embodiment, the connection port is a female type housing, in which a plug is connected with a male type protuberance fitting the geometry of the female type housing.

On the other hand, it is understood a reticular slab is made up of a base slab of constant thickness arranged in a horizontal plane, which has orthogonal X and Y axes between each other. In addition, the reticular slab includes a plurality of nerves arranged in a reticular arrangement; the nerves above come out of the base slab. If all the ribs are the same height, the reticular slab has a constant cross-section. On the other hand, if the ribs decrease in height from the edges of the slab towards the center, the reticular slab has a variable cross-section.

Variable section reticular slabs may have a variable section on the X axis, variable section on the Y axis, or a combination thereof.

In variable cross-section reticular slabs on the X-axis the cross-section of the ribs decreases on the x-axis from the edge of the slab to the center of the slab, but remains constant along the Y-axis. Similarly, in variable-section reticular slabs, the ribs decrease on the Y-axis from the edge of the slab to the center of the slab, but remain constant along the X-axis.

On the other hand, reticular slabs of variable cross-section in both X and Y axes have ribs with decreasing cross-section from the slab edges to the center of the slab.

Variable section reticular slabs allow more concrete to be concentrated in areas of greater mechanical stress, such as slab edges, and slab initiations and terminations on beams, walls and columns. In this way, it is avoided to put concrete in points of low solicitation saving concrete volume, and lighter structures are obtained, which also implies to have columns and foundations of smaller sections and because it lowers the dead load they must support.

Referring to FIG. 2, in an invention embodiment, in order to form the reticular slab, the coffers (1) are aligned so their lower edges are collinear to each other. In this way, the sheets (2) of the coffers (1) remain in the same horizontal plane, thus guaranteeing the constant thickness of the base slab.

In order to form a reticular slab of constant cross-section, the structural elements (4), such as beams (8), T (50) and crosses (29), are connected to the holes (5) of the plates (3), where the holes (5) are at the same height measured from the lower edge of the coffers (1).

On the other hand, in order to form a slab with variable cross-section, the structural elements (4) are connected to the holes (5) of the plates (3) in a decreasing or increasing manner in the direction in which the thickness is intended to vary.

For example, as shown in FIG. 2, a structural element (4) is connected to the coffer (1) on the left, aligning the lateral perforation (9) with the sixth hole (5) (measured from the lower edge of the plate (3)) of the plate (3) on the left.

Also, a beam (8) is connected between the right plate (3) of the left coffer (1) and the left plate (3) of the right coffer (1). In this case, the lateral perforations (9) of the skid (51) are aligned with the fourth hole (5) measured from the lower edge of the plates (3) of these plates (3) of the coffers (1).

Figure 3:
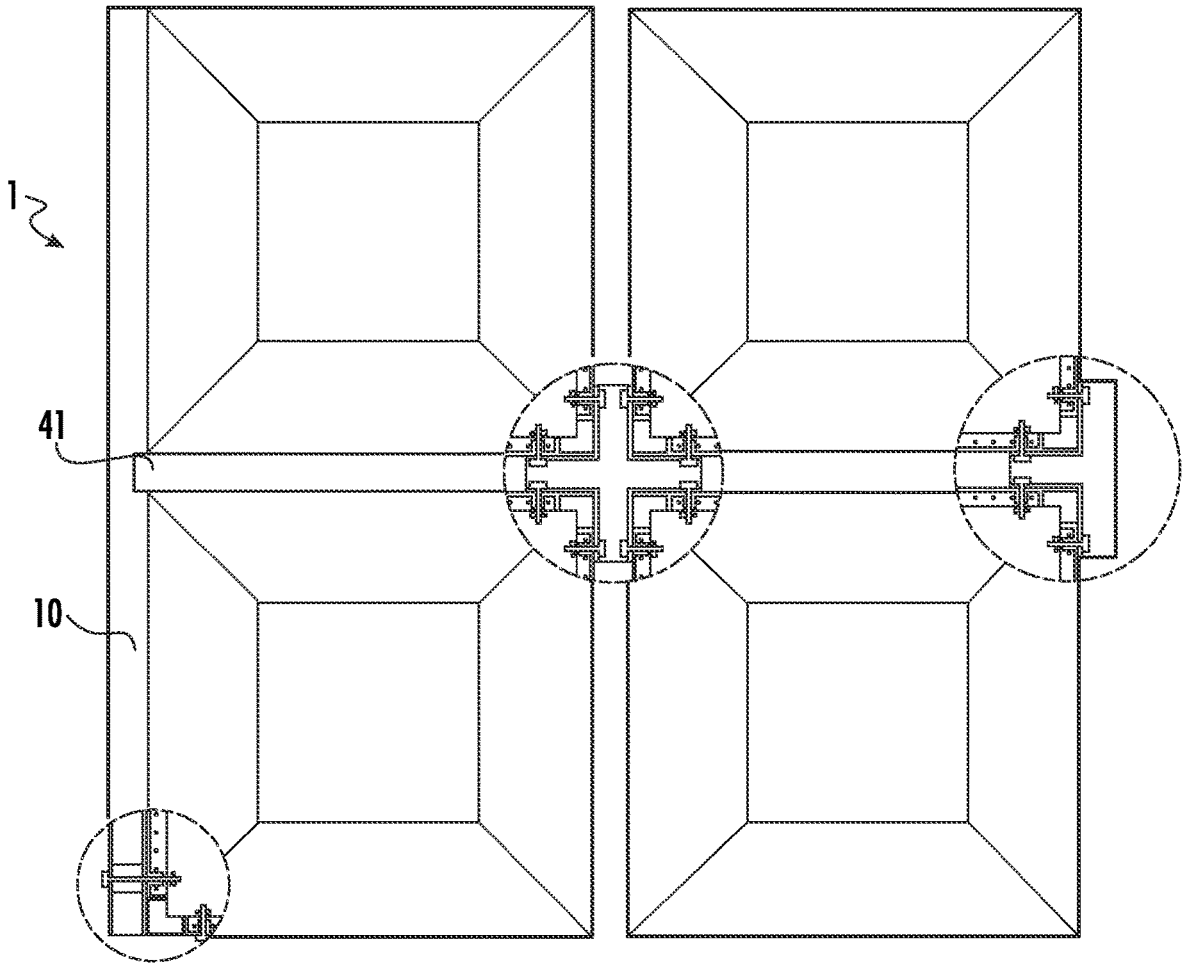
FIG. 3 corresponds to a top view of four coffers connected to each other with structural elements (beam, cross, T), in a formwork mechanism embodiment.

Referring to FIG. 3, in an invention embodiment, the structural element (4) is a cross (29). The cross (29) has four joists (13), each joist (13) has a side hole (14) which is aligned with a hole (5) in a plate (1). At the cross (29) are connected four coffers (1) with fixing means (7) going through the holes (5) and the side holes (14).

In an unillustrated invention embodiment, the cross (29) has its lateral faces inclined inwards, so the lateral faces are coupled to the inclination of the coffers (1) inclined.

Referring to FIG. 3, in an invention embodiment, the structural element (4) is a T (50), the T (50) has three joists (13), each joist (13) has a side hole (14) which is aligned with a hole (5) of a plate (1).

The cross (29), and the T (50) allow to interconnect the coffers (1) in a fast and simple way, especially when the fixing means (7) are pin-crushes, due to their easy installation that only needs a hammer or a mallet. However, the fixing means (7) can also be bolts, screws, plates and combinations thereof.

On the other hand, on the crosses (29), beams (8) and/or Ts (50), boards (41) are arranged; where boards (41) allow to form a continuous surface on which the liquid concrete will be supported.

The boards (41) may be made of wood, plastic or metal. Also, the boards (41) may be rigid or flexible.

Rigid boards (41) are ideal for the construction of formworks for homogeneous cross-section reticular slabs; flexible boards (41) are ideal for the construction of variable cross-section beams and reticular slabs, as they allow a curve to be described interconnecting crosses (29), beams (8) and/or Ts (50).

The boards (41) may simply be supported on the crosses (29), beams (8) and/or Ts (50). Also, boards (41) may be connected to crosses (29), beams (8) and/or T (50) by fixing means, such as screws (e.g. self-drilling, self-tapping), bolts, rivets, adhesives, and combinations thereof.

In an invention embodiment, the cross (29) and the T (50) have their upper faces rounded. This allows the flexible boards (41) to be settled more comfortably.

Referring to FIG. 2 and FIG. 3, in an invention embodiment, the structural element (4) is the beam (8) consists of a first structural profile (10) and a skid (51) that slides over the first structural profile (10), the skid (51) has the lateral perforations (9). The lateral holes (9) are aligned with the holes (5) of the plates (3) on the coffers; on the other hand, to secure the beam (8) to a coffer (1), a fixing means (7) is put through the holes (5) and the lateral perforations (9). Preferably, the fixing means (7) is a wedge pin.

It will be understood in the present invention that skid (51) is an element that fits inside the first structural profile (10). The skid (51) may be a segment of an I-profile. Also, the skid (51) may have wheels that rest on the inner face of the first structural profile (10).

In an invention embodiment, the skid (51) and the first structural profile (10) are blocked with a pin that crosses them and prevents relative displacement between them. Also, the skid (51) and the first structural profile (10) may be secured together with wedges.

In an invention embodiment, two parallel plates (3) are separated horizontally by a spacer (20), which allows the plates (3) to remain aligned vertically and parallel to each other.

Figure 4A:
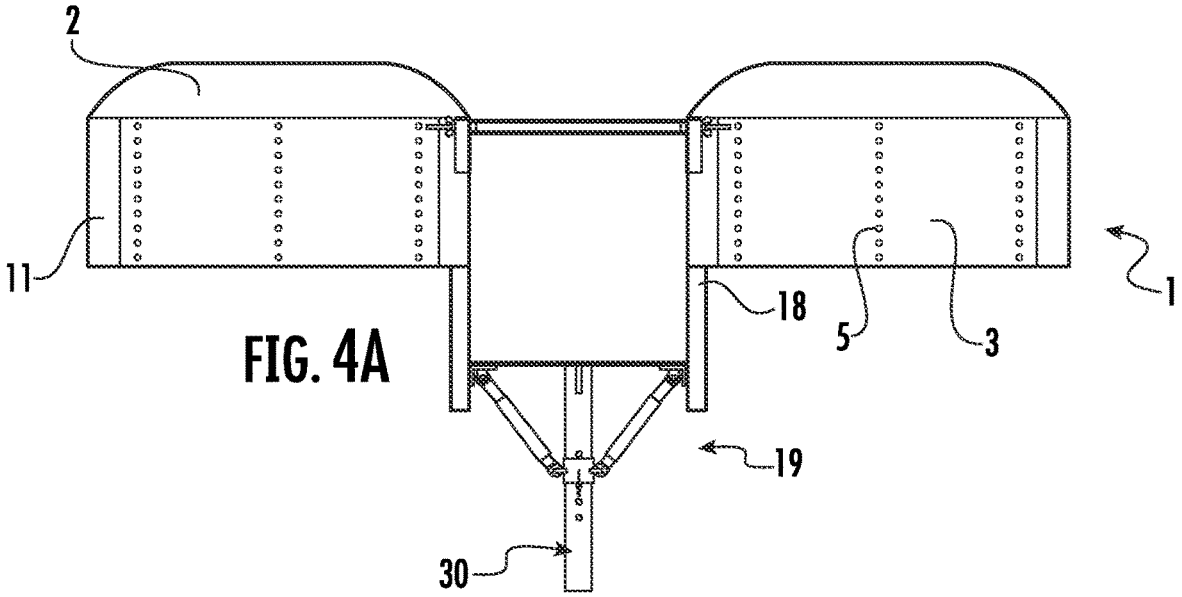
FIG. 4A corresponds to a cross-sectional view of a reticular slab set with coffers, and a hanging beam formwork connected to the coffers, in the embodiment of a formwork mechanism coffer.
Figure 4B:
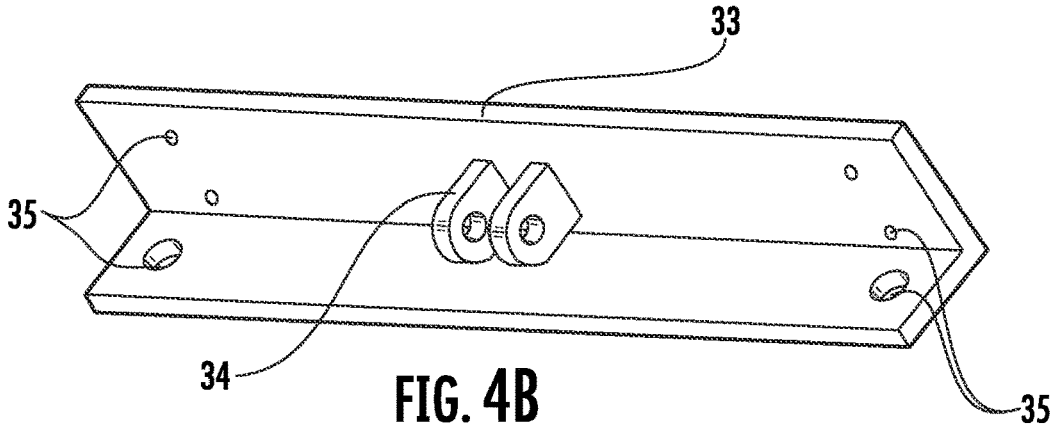
FIG. 4B corresponds to one embodiment of a support beam according to the present invention.
Figure 4C:
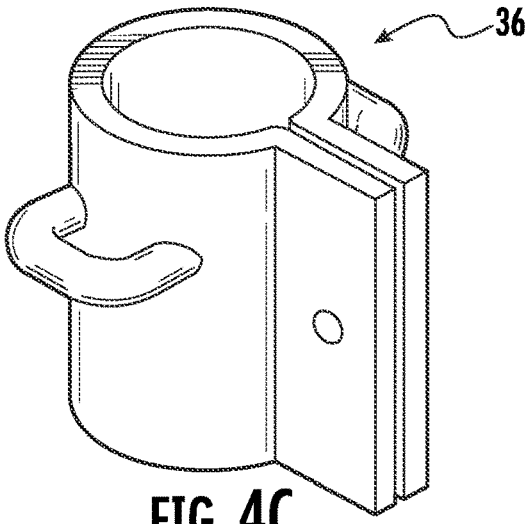
FIG. 4C corresponds to one embodiment of a hub of the formwork mechanism according to the present invention.

Referring to FIG. 4A-4C, in an invention embodiment, each spacer (20) comprises:

- a threaded rod (21) with a first end (22) and a second end (23), the threaded rod (21) goes through the hole (5);
- two nuts (24), each nut (24) is connected to one end of the threaded rod (21);
- one nut (27) connected to the threaded rod (21) near the second end (23), between the nut (27) and one of the nuts (24) is the plate (3);
- a stop (28) connected to the threaded rod (21) between the first end (21) and the second end (22), and
- a tube (26) arranged concentrically with the threaded rod (21), and located between the plates (3).

The spacer (20) prevents the plates (3) from attempting to join or separate, thus guaranteeing the distance of the concrete piece to be hardened between the plates.

The threaded rod (21) may be threaded along its entire length, or only at its ends. On the other hand, the threaded rod (21) and nut (27) may have a metric, square, ACME class, ANSI, or combinations thereof. Preferably, the threaded rod (21) is threaded over its entire length and its thread is square or ACME class; likewise, the nut (27) is square or ACME class. The nut (27) may be a hex nut, crenellated or a nut-counter nut assembly.

In an invention mode the stop (28) is a nut attaching securely to the threaded rod (21). For example, the nut may be crenellated, or hexagonal with a radial hole, and the threaded rod (21) include at least one radial hole, where the radial holes are aligned and a pin is inserted blocking the relative movement between the stop (28) and the threaded rod (21). This allows the stop (28) to be detached from the threaded rod (21), which makes the spacer (20) modular and easy to maintain.

In an invention embodiment, the threaded rod (21) is threaded only at its ends. On the other hand, the stop (28) is a hub with a radial hole, and the threaded rod (21) includes at least one radial hole, where the radial holes are aligned and a pin is inserted blocking the relative movement between the stop (28) and the threaded rod (21).

In an invention embodiment, the stop (28) is connected to the threaded rod (21) by welding (e.g. SMAW, GMAW, GTAW, FCAW, and other methods accepted by the American Welding Society), or by adhesives (e.g. epoxy adhesives, methacrylates, acrylics, and combinations thereof).

In an invention embodiment, nuts (24) may be hexagonal, square, butterfly, crenellated, grooved, knurled head, or self-locking. Preferably the nuts (24) are butterfly nuts. Wing nuts allow quick and easy adjustment by hand, without the need for tools such as wrenches and ratchets.

The tube (26) extends between the plates (3) and covers all other elements of the spacer (20). The tube (26) prevents the concrete poured between the plates (3) from coming into contact with the other elements of the spacer (20). On the other hand, the tube (26) is embedded in the concrete when it is finally cured.

In one invention embodiment, the tube (26) is made of a plastic material, preferably polyvinyl chloride (PVC). On the other hand, the threaded rod (21), nuts (24 and 27) and stop (28) may be made of a metallic material, e.g. carbon steel, stainless steel, alloy steels (e.g. chromium, nickel, molybdenum and combinations thereof).

In order to install the spacer (20) follow the steps:

a) Insert the nut (27) into the threaded rod (21) at its second end (23);

b) Insert the second end (23) into a hole (5) on a first plate (3);

c) connect a first nut (24) to the second end (23) and tighten it, thus securing the first plate (3) against the nut (27);

d) position the tube (26) concentrically with the threaded rod (21), inserting the first end (22) of the threaded rod (21) into the tube (26);

e) position the first plate (3) parallel to a second plate (3), and align by inserting the first end (22) into a hole (5) of the second plate (3);

f) connect a second nut (24) to the first end (22) and tighten it, thus securing the second plate (3) against the stop (27).

Referring to FIG. 4A-4C and FIG. 5A-5B, in an invention embodiment, under a plate (3) of the coffer (1), a hanging beam formwork is connected comprising:

a first extension plate (25) connected to the plate (3);

a second extension plate (18) located at the front of the extension plate (25);

where the extension plates have holes (5) arranged on their front faces; and a support beam (19) connected to the holes (5) extension plates with fixing means, where the second extension plate (18) is connected to another coffer (1).

In an invention embodiment, the first extension plate (25) and the second extension plate (18) have the same dimensions and features as plates (3).

In an invention embodiment, the first extension plate (25) and the second extension plate (18) have a length and height greater than the plates (3), for example, may have between 1.2 and 2.5 times their length and/or height, so you can connect more quickly the extension plates to the plates (3), saving installation time, because it avoids handling more elements and avoiding having to secure more plates (3) with fixing means (7).

The first extension plate (25) and the second extension plate (18) serve to generate a cavity deeper than that which may be generated by the coffers. This deep cavity is a mold for beams and slab areas higher than the height of the coffers (1), which is necessary to build beams with high load-bearing capacity, or beams and slabs with large spans, for example, of more than 10 m.

The support beam (19) includes holes located on its side, which are aligned with the holes (5) of the plates (3), or the support plates.

In an invention embodiment, the support beam (19) includes a plurality of connection ports on its underside, which are operationally connected to plugs or newels.

Referring to FIG. 4A-4C and FIG. 5A-5B, in an invention embodiment, the support beam (19) is made of:

at least one support newel (46) with:

one block (3) with a plurality of perforations (31);

a support surface (32) at the upper end of the block (3);

two angles (33) connected below the supporting surface (32), each angle (33) has a horizontal plate, a vertical plate attached to the horizontal plate, and a connecting port (34) at the inner vertex of the plates, additionally, each angle (33) has lateral perforations (35), where the lateral perforations (35) are aligned with the holes (5);

one hub (36), with two ears (37) extending radially, the hub (36) is concentrically arranged with respect to the block (3);

a fixing means (7) that passes through one of the holes in the block, the fixing means (7) is located under the hub (36);

two extensible brackets (39), each extensible bracket (39) is connected to one hub ear (37), and to the connecting port (34) from an angle (33); and one sheet (40) resting on the support surface (32) of the support newel (46).

The holes (31) in the block (3) make it possible to adjust the height of the hub (36), and thus the height of the bearing surface (32). Perforations (31) may be located only at the top end of the block (3), or along its entire length.

In an invention embodiment, the block (3) has a longitudinal advance mechanism which allows the length of the cue to be adjusted. The longitudinal feed mechanism may be a screw mechanism, or a telescopic concentric cylinder mechanism. In the case where the longitudinal advance mechanism, that of telescopic cylinders, the block (3) is made up of a first cylinder and a second cylinder arranged inside the first cylinder, where the cylinders have perforations (31) located 20 along their length, and where the cylinders are secured to each other with pins inserted into the perforations (31).

On the other hand, the supporting surface (32), may be a plate with a length greater than its width and thickness; or it may also be a plate with a width greater than its length and thickness. The support surface (32) may be made of wood, plastic or metal. If it is metal, it may be steel, aluminum, or brass. In addition, the supporting surface (32) includes lateral perforations (35) near its longitudinal ends, these lateral perforations (35) are aligned with some holes with angles (33) in their upper face.

In an invention embodiment, the support surface (32) is secured to the angles (33) with fixing means selected among: screws, bolts, self-drilling screws, self-tapping screws, pins, rivets and combinations thereof.

The angles (33) allow the load to be transmitted from the boxes (1) to the extensible bracket (39). The lateral perforations (35) located in the vertical stage align with the holes (5). To secure the angles (33) to the coffers (1), fixing means (7) are inserted through the lateral perforations (35) and the holes (5). Preferably, the fixing means (7) are pin-wedges.

The hub (36) may have an adjustable internal diameter. This feature allows the same hub (36) to be used for blocks (3) of different diameters, since the diameter of the blocks (30) depends on their length and the maximum load they can support. On the other hand, this characteristic allows the hub (36) to adapt to the geometry of commercial plugs and newels.

Referring to FIG. 4A-4C and FIG. 5A-5B, in an invention embodiment, the hub (36) is a sheet that is bent in a cylindrical manner, leaving the sheet edges facing out of the cylinder. The sheet edges have collinear perforations between them; in these perforations a screw, or bolt, is inserted allowing to adjust the distance between the sheets, and therefore, the diameter of the hub cylinder (36). On the other hand, two ears (37) extend radially out of the hub (36); each ear (37) connects to an extensible bracket (39). The extensible bracket (39) transmit the load from the angles (33) to the hub (36), while the hub (36) transmits the load to the block (3) by means of the fixing means (7), while the block (3) transmits the load to the ground, or support surface on which it rests.

In an invention embodiment, the sheet (40) rests on a slab contiguous to the coffers (1) and on the supporting newel (46). Also, the sheet (40) may be supported on the knot of a reinforced concrete column. In this way, the concrete that is poured over the coffers (1) and the sheet (40) is integrated with the knot of the concrete column, generating the union of the reticulated slab that is formed with said coffers (1), with said concrete column when the poured concrete is cured.

Preferably, the sheet (40) is flexible. This allows the sheet (40) to follow a curved path, which can generate variable cross-section beams and slabs.

In an invention mode, the support beam (19) has at least two support newels (46). This ensures the stability of the film (40).

In an invention embodiment, the support beam (19) consists of a plurality of supporting newels (46) arranged along the underside of the sheet (40).

Figure 5A:
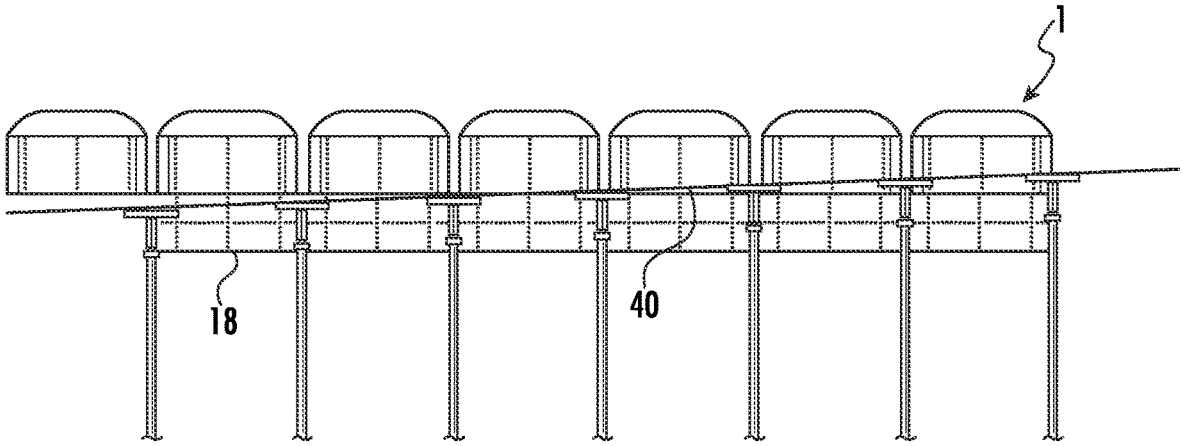
FIG. 5A corresponds to a side view of a coffer of a formwork mechanism for a curved reticular slab.
Figure 5B:
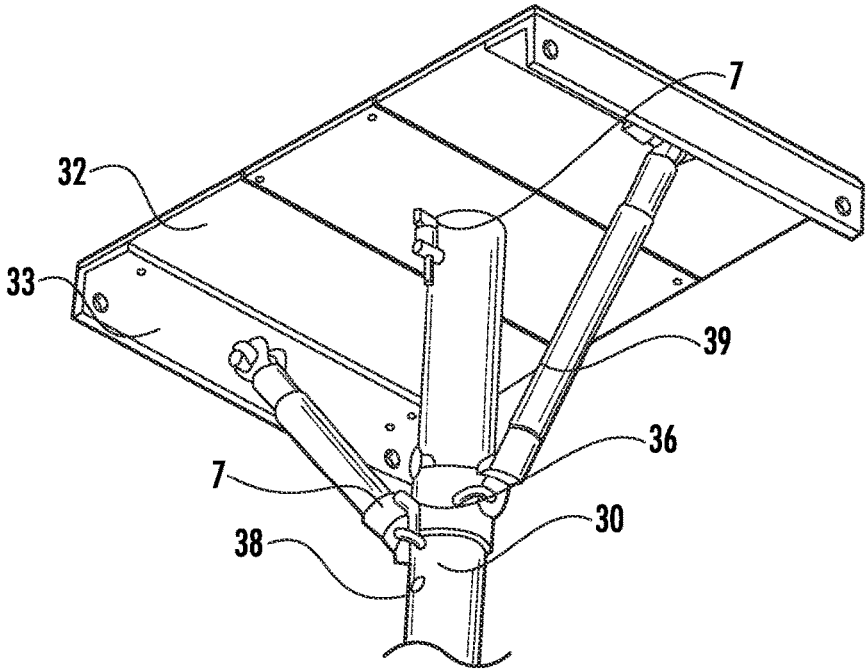
FIG. 5B corresponds to a perspective view of a portion of one embodiment of a hanging beam formwork connected to coffers according to the present invention.

Referring to FIG. 5A-5B, in an invention embodiment, the supporting newels (46) are arranged so that the height of their supporting surfaces (32) form a ladder on which the sheet (40) is arranged. As the sheet (40) is flexible, this forms a curved path, which can generate beams and slabs of variable cross-section.

In one invention embodiment, as shown in FIG. 9A-9B, the flexible sheet (40) has at one longitudinal end a tapered tab (101) connected to a column formwork (97) comprising:

- a curved panel (100) with:
  - a first punctured tab (102) connected to the punctured tab (101) with fixing means (7);
  - a second perforated tab (103) connected to a vertically arranged plate (3);
  - a hole (5) located between the tabs (102 and 103) of the curved panel (100);
- an adapter (104) with a curved perforated surface (98) that connects to the hole (5) of the curved panel (100) with fixing means (7); and with a horizontal plate (99) that has a cavity; and
- a plug (105) with a male adapter (106) located at its upper longitudinal end which is inserted into the adapter cavity (104).

The curved panel (100) allows to generate a curvature between the flexible sheet (40) and the vertical plate (3). This curvature allows for a smooth transition between the hanging beam and the structural column (67), thus reducing the stress concentrator generated between the hanging beam and the structural column (67).

The curved panel (100) has at least one hole (5), however, it may have one.

In an invention embodiment, the curved panel (100) has three horizontal rows of holes (5).

In an invention embodiment the structural column (67) is of round cross-section. In this mode, the vertically arranged plate (3) is cylindrical in shape with an internal diameter equal to the diameter of the structural column (67). Under the plate (3) more plates (3) are connected in the same way, from the point at which the structure column (67) is to be formed, for example, a top knot of another structural column, a slab or a mortar, to the plate (3) connected to the curved panel (100).

In one invention embodiment, the structural column (67) is of rectangular cross-section. To achieve this rectangular cross-section, at least four plates (3) connected to each other with fixing means (7) are arranged in a rectangular arrangement. If the column is higher than the plates (3), more rectangular arrangements of plates (3) are connected, from the point at which the column structure (67) is to be formed, for example, a top knot of another structural column, a slab or a concrete, to the plate (3) connected to the curved panel (100).

The adapter (104) allows the curved panel (100) to be connected to the block (105), thus giving it structural support and guaranteeing its dimensional stability. The plug (105) has a male adapter (106) located at its upper longitudinal end that is inserted into the adapter cavity (104), thus generating a quick and secure coupling, which does not require additional fixing means.

The adapter (104) has a curved perforated surface (98) which is connected to the holes (5) of the curved panel (100) with fixing means (7).

In an invention embodiment, the holes (5) of the curved panel (100) are countersunk, and the fixing means (7) are pin wedges with countersunk head. This allows the fixing media (7) to 40 be completely inserted into the curved panel (100), preventing the concrete from sticking to their heads.

Figure 6:
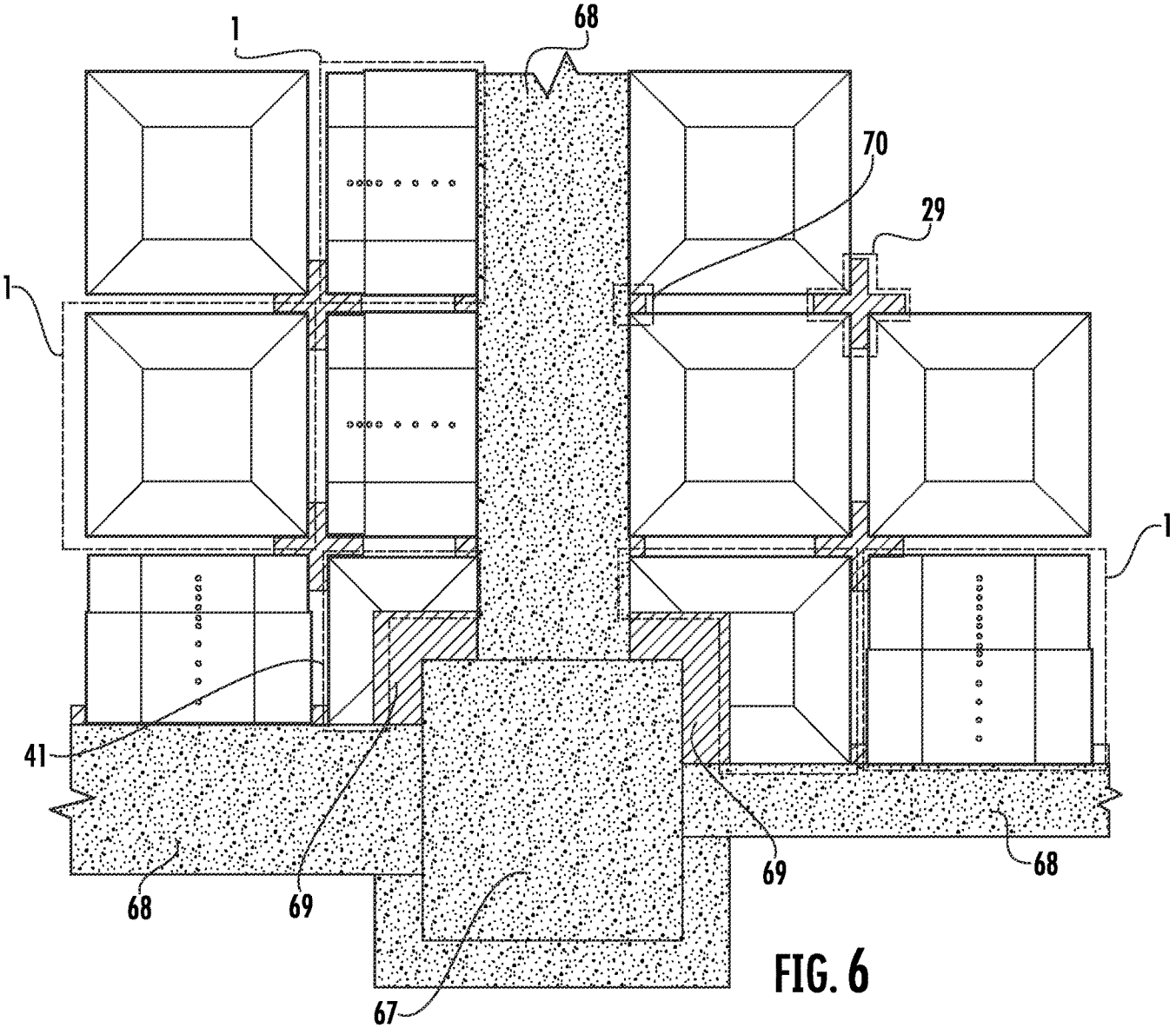
FIG. 6 corresponds to a top view of a formwork for a reticular slab made up of coffers.

On the other hand, FIG. 6 refers to a top view of a formwork for a reticular slab. The reticular slab is joined to a structural column (67) and three structural beams (68). The structural column (67) and structural beams (68) are reinforced concrete.

The formwork includes L-type coffers (1) connected to the structural column (67); coffers (1) sliders connected to the structural beams (68) and coffers (1) straight connected to the L-type coffers (1), and sliders.

In the rectangular cut (54) of the L-type coffers (1), there are non-recoverable coffers 10 (69), which are embedded in the concrete after is cured. These non-recoverable coffers (69) reduce the volume of concrete in the node, without structurally damaging it.

In an invention embodiment, the structural column (67) and/or the structural beams (68) have knots that protrude from their upper surface, that is, from the upper surface where the concrete is poured and the reticular slab is formed.

It will be understood in the present invention that knots are metallic structures or frameworks protruding from concrete structures reinforced with metallic bars.

In an invention embodiment, to connect the coffers (1) to the structural beams (68) structural profiles (70) are used, connecting to the structural beams (68), either because at the time of setting they had those structural profiles (70) embedded, or because they are connected to fixing means, such as bolted tabs. The structural profiles (70) have perforations aligned with the holes (5) of the coffers (1) plates (3), in order to insert fixing means (7), such as pin wedges, plates, bolts, screws and combinations thereof, which secure the coffers (1) to the structural profiles (70).

Structural profiles (70) may be C-cross section, U-cross section, I-cross section, square cross section, round cross section, tubular cross section and combinations thereof.

The coffers (1) are joined together with crosses (29). As mentioned above, the crosses (29) are interconnected with boards (41), which may be either rigid or flexible.

Referring to FIG. 6, in an invention embodiment, the reticular slab form allows for the formation of reticular slabs of variable cross-section. In this case, the cross-section of the reticular slab decreases as the slab moves away from the beams (68).

Figure 7A:
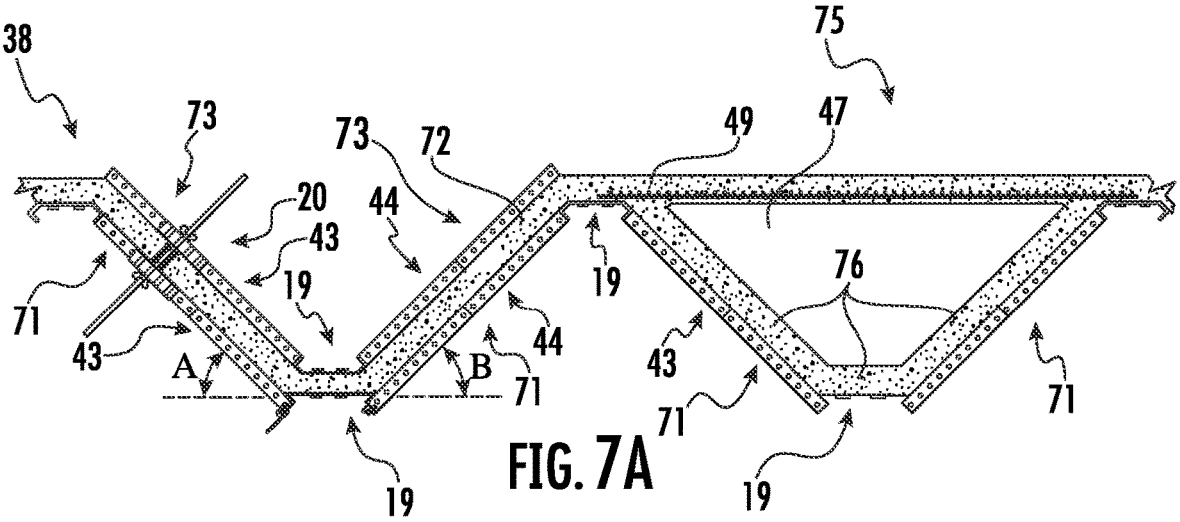
FIG. 7A corresponds to a cut-off view of one embodiment of a formwork mechanism coffer for a folded slab conformed with coffer plates.
Figure 7B:
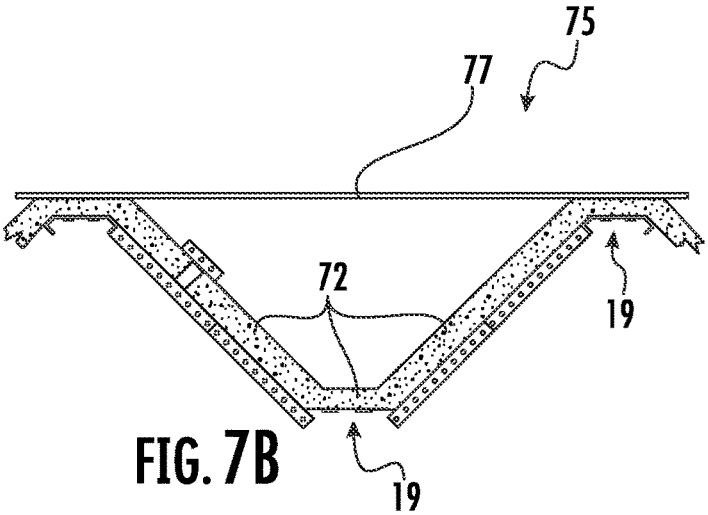
FIG. 7B corresponds to a cut-off view of another embodiment of a formwork mechanism coffer for a folded slab conformed with coffer plates.

Referring to FIG. 7A-7B, in an invention embodiment, the formwork mechanism includes:

a first module (43) consisting of two plates (3) connected to each other and arranged in parallel, the first module (43) has an inclination (A):

second module (44) consisting of two plates (3) connected to each other an arranged in parallel, the second module (44) has an inclination (B);

a first support beam (19) with two punctured tabs arranged on its side faces, each punctured tab of the first support beam is connected to a punctured tab (6) of each plate (3) of one of the modules; and;

a second support beam (19) with two punctured tabs (45) arranged on their side faces, each punctured tab of the second support beam (19) is connected to a punctured tab (6) of each plate (3) of the second module;

where the tabs of the support beams (19) form an angle between 0° and 180°.

This embodiment of the formwork mechanism allows to form folded slabs for floors and/or ceilings. Folded slabs are made up of panels connected together along their edges, where folds are formed at those edges; folds may be tops or valleys. Folded slabs are used in structures with wide spans, and are usually used for ceilings and floors.

It will be understood in the present invention that top, or fold top, is a fold in which a first module (43) is joined with a second module (44) so that the angle measured between the front faces of their plates (3) is an angle between 180° and 360°. Also, valley, or valley fold, shall be understood as a fold in which a first module (43) is joined with a second module (44) so that the angle measured between the front faces of their plates (3) is an angle between 0° 20 and 180°. In the case that the angle measured between the front faces of their plates (3) is an angle of 180°, there is no fold.

Although the angle may be between 0° and 180°, it should be noted that for angles other than 90°, the concrete is subjected to bending and traction stresses, which implies having much greater slab thicknesses in the case of slabs folded at 90°, which makes the structure heavier and more expensive. This is because concrete has excellent compressive strength, but low tensile strength.

However, for other curable materials, e.g. plastic resins (e.g. epoxy, polyester, vinyl ester) which may or may not be reinforced with fibers (e.g. polyester, glass, aramid, carbon), angles other than 90° may be used.

In an invention embodiment, for top folds, the angle measured between the front faces of the plates (3) is an angle of 90°. On the other hand, for valley folds, the angle measured between the front faces of the plates (3), is also an angle between 90°.

In an invention embodiment, the support beams (19) have trapezoidal cross sections, where the punctured tabs (45) are the inclined sides of the trapeze.

In an invention embodiment, the trapezoidal section of the support beams (19) are hollow. In this way, the support beams (19) are lighter than if they were solid.

In an invention embodiment, the trapezoidal section of the support beams (19) has no greater base, thus the support beam is lighter than, if it were a solid trapeze, or tubular with a greater base. In this mode, the support beam (19) is used for the valley folds. On the other hand, in this mode, the smaller base external face of the support beam (19) is put in contact with the concrete that is cured on the front face the plates (3) of modules (43 and 44).

In an invention embodiment, the smaller base inner face of the support beam (19) has a connection port in which a block (30) or a support newel (46) is connected.

In an invention embodiment, the trapezoidal section of the support beams (19) has no minor base. This type of support beam (19) is used to form the top folds. On the other hand, the external face of the greater base is put in contact with the concrete that is cured on the front face, the plates (3) of the modules (43 and 44).

In an invention embodiment, the greater base internal face of the support beam (19) has a connection port in which a block (30) or a support newel (46) is connected.

In an invention embodiment, the first module (43) and the second module (44) are connected to each other with a support beam (19) of trapezoidal cross-section without major base.

Referring to FIG. 7A-7B, in an invention embodiment, the formwork mechanism is a folded ceiling slab form (38) comprising a plurality of fold forms connected to each other with support beams (19), each fold form includes:

an upper assembly (73) consisting of a first module (43) with inclination (A) connected to a second module (44) with inclination (B) by means of a first support beam (19); and a lower assembly (71) consisting of a first module (43) with inclination (A) connected to a second module (44) with inclination (B) by means of a first support beam (19); where the upper assembly (73) and the lower assembly (71) are separated by a predetermined distance with spacers (20) connected to the first modules (43) and the second modules (44);

where the upper assembly (73) and the lower assembly (71) are separated by a predetermined distance with spacers (20) connected to the first modules (43) and the second modules (44).

The folded ceiling slab form (38) is used to set and cure a folded ceiling slab (72). The predetermined distance separating the assemblies (70 and 71) corresponds to the thickness of the folded ceiling slab (72), which is selected according to the loads and spans to which it is subjected.

In an invention embodiment, the inclination A is 135° and the inclination B is 45°, both measured from the horizontal having as origin the centroid of the support beam (19). In this way, each fold form forms a valley fold. Therefore, the beams (19) joining the folding forms form the top folds. In this mode, the folded slab is a slab subjected to compressive stresses, as the sides of its folds are angularly separated by 90°.

The spacers (20) maintain the distance between the first modules (43). Likewise, the distance between the second modules (43) is maintained with spacers (20).

Referring to FIG. 7A-7B, in an invention embodiment, the support beam (19) that connects the modules (43 and 44) into an upper assembly (73), and the support beam (19) that connects the second module (44) of a lower assembly (71) of a first fold form with the first module (43) of a lower assembly (71) of a second fold formwork, is a profile with a truncated pentagonal cross section. The truncated pentagonal section has a truncation that cuts two of its sides. The pentagonal section has one side longer than the others, which is arranged horizontally. On the other hand, the truncation is parallel to the longer side. The truncation allows access to the inner side of the pentagon longest side, where a female connection port (74) is located.

It will be understood in the present invention the internal faces of the pentagon sides are the faces with normal vector pointing into the pentagon. Also, it will be understood that the outer faces of the pentagon are the faces with a normal vector pointing out of the pentagon.

In order to connect the modules (43 and 44) in a top assembly (73), the pentagon outer face of the longest side is in contact with the top face of the folded ceiling slab (72). Therefore, the female connection port (74) is accessed from above the top assembly (73).

On the other hand, to connect the second module (44) of a lower assembly (71) of a first folding form with the first module (43) of a lower assembly (71) of a second folding form, thus forming a top fold, the pentagon outer face of the longest side is in contact with the top face of the folded ceiling slab (72). Therefore, the female connection port (74) is accessed from below the lower assemblies (71). In this way you can connect a block (30) having a male coupling that is inserted into the female connection port (74).

In an invention embodiment, the connection between the female connection port (74) and the male plug coupling (30) is slippery. The sliding joint may be a dovetail, or a skid-rail mechanism, where the rail is the female connection port (74), which is made up of two elongated tabs located; and the skid is the male coupling of the block (3).

On the other hand, referring to FIG. 7A-7B, the support beams (19) connecting the modules (43 and 44) of the lower assembly (71) (valley fold) are made up of five rectangular sides joined in the shape of a truncated double trapezoid. The truncated double trapezoid consists of an upper trapezoidal section and a lower trapezoidal section.

The upper trapezoidal section has as its major base a first rectangular side arranged horizontally, which is the widest of the five rectangular sides. From the first rectangular side, two rectangular sides forming the lateral faces of the upper trapezoidal section extend diagonally and converge. However, the upper trapezoidal section does not include a minor base.

On the other hand, the lower trapezoidal section has neither a major nor a minor base, but has two rectangular sides, where each rectangular side is connected to one of the rectangular sides composing the lateral faces of the upper trapezoidal section. The rectangular sides of the lower trapezoidal section extend diagonally and divergently.

Preferably, the angle formed by the rectangular sides of the upper trapezoidal section with the rectangular sides of the lower trapezoidal section is a right angle. This makes it easier for the plates (3) of the modules (43 and 44) to settle on the support beam (19).

In an invention embodiment, after the folded ceiling slab (72) has been cured, fiber cement plates (77) are placed on top of the folded ceiling slab (72), which are secured with fixing means (7), such as chasers, screws, bolts, adhesives and combinations thereof. Preferably, the fiber cement plates (77) are arranged in such a way the joints are interspersed from one top to the other.

On the fiber cement plates (77), floor finishings may be made for thermal and acoustic insulation. In addition, the folded ceiling slab (72) with fiber cement plates (77) allows between the air duct folds hydrosanitary, electrical, telephone, data, and other installations. Moreover, it facilitates cleaning and maintenance.

Referring to FIG. 7A-7B, in an invention embodiment, the formwork mechanism is a folded floor slab formwork (75) comprising a plurality of fold forms connected to each other with support beams (19), each fold formwork includes:

a lower assembly (71) comprising a first module (43) with inclination (A) connected to a second module (44) with inclination (B) by means of a first support beam (19);

a full (47) arranged above the lower assembly (71); and one mesh (48A) arranged within the full (47).

In an invention embodiment, the inclination A is 135° and the inclination B is 45°, both measured from the horizontal having as origin the centroid of the support beam (19). In this way, each fold formwork forms a valley fold. Therefore, the beams (19) joining the folding formworks form the top folds. In this mode, the folded slab is a slab subjected to compressive stresses, as the sides of its folds are angularly separated by 90°.

Before hardening the concrete, the full (47) is placed on the modules (43 and 44) of the lower assembly (71), which preferably has a trapezoidal cross section. The smaller base of the filler (47) is oriented towards the smaller base of the support beam (19). The full (47) is completely covered with concrete (76), leaving a cavity within the concrete slab (46), which saves concrete and increases the inertia of the slab. In addition, the mesh (48A) is also covered by concrete. Preferably the mesh (48A) is an electro-welded carbon steel mesh. This creates one of the folds of a folded floor slab.

Referring to FIG. 7A-7B, in an invention embodiment, the support beam (19) connecting to the top folds the second module (44) of a lower assembly (71) of a first fold form with the first module (43) of a lower assembly (71) of a second fold formwork, is a profile with a truncated pentagonal cross section.

The truncated pentagonal section has a truncation that cuts two of its sides. The pentagonal section has one side longer than the others, which is arranged horizontally. On the other hand, the truncation is parallel to the longer side. The truncation allows access to the pentagon inner side of the longest side, where a female connection port (74) is located. This way, a block (30) having a male coupling inserted into the female connection port (74) can be connected.

On the other hand, referring to FIG. 7A-7B, the support beams (19) connecting the modules (43 and 44) of the lower assembly (71) (valley fold) are composed of five rectangular sides joined in the shape of a truncated double trapezoid. The truncated double trapezoid consists of an upper trapezoidal section and a lower trapezoidal section.

The upper trapezoidal section has as major base a first rectangular side arranged horizontally, which is the widest of the five rectangular sides. From the first rectangular side, two rectangular sides forming the lateral faces of the upper trapezoidal section extend diagonally and converge. However, the upper trapezoidal section does not include a minor base.

On the other hand, the lower trapezoidal section has neither a major nor a minor base, but has two rectangular sides, where each rectangular side is connected to one of the rectangular sides composing the lateral faces of the upper trapezoidal section. The rectangular sides of the lower trapezoidal section extend diagonally and divergently.

Preferably, the angle formed by the rectangular sides of the upper trapezoidal section with the rectangular sides of the lower trapezoidal section is a right angle. This makes it easier for the module plates (3) (43 and 44) to sit on the support beam (19).

Referring to FIG. 8, in an invention embodiment, plates (3) are used to assemble a formwork for a wall (78).

In an invention embodiment, the wall formwork (78) comprises a first assembly of wall formwork (82) comprising:

a first vertical module (79) and a second vertical module (80) located at the front of the first vertical module (79), each vertical module (79 and 80) has at least two plates (3) connected to each other and arranged in parallel;

a plurality of spacers (20) connecting the plates (3) of the first vertical module (79) with the plates (3) of the second vertical module (80); and at least two side panels (81) connected to the side ends of the vertical modules (79 and 80).

In an invention embodiment, the plates (3) of the wall formwork (78) have diagonal ribs (49) and stiffening profiles (48) increasing the stiffness of the plates, and allowing a better dimensional stability of the wall formwork (78).

In order to connect the plates (3), place them side by side, aligning and securing the punctured tabs (6) with fixing means (7).

In an invention embodiment, the plates (3) have dimensions less than 2 m, therefore, in order to build high walls, it is necessary to extend the height of the wall formwork (78). This is accomplished by adding a second wall formwork assembly (83) above the first wall formwork assembly (82), and securing the wall formwork assemblies (82 and 83) with fixing means (7). The fixing means (7) go through the lower punctured tabs (6) of the plates (3) of the second wall form assembly (83) and the upper punctured tabs (6) of the plates (3) of the first wall formwork assembly (82).

Preferably, the fixing means (7) are small plates and wedge-pins.

In order to form a wall, the wall formwork (78) is installed on top of a support surface, e.g. a slab or mortar. Concrete is then poured between the vertical modules (79 and 80) and the side panels (81). Before casting the concrete, steel reinforcements, such as rods, meshes and plates, may be installed, which give greater resistance to the wall.

In an invention embodiment, bracing blocks (84) are connected to the plates (3) of the wall formwork (78). The bracing blocks (84) are used to support the wall formwork (78) in a vertical position.

In an embodiment of invention, each bracing block (84) comprises:

a base bracket (85) comprising:

a base plate (86) with perforations; the base plate (86) is connected to the supporting surface on which the wall is built, e.g. a slab or a mortar with fixing means (7), such as bolts, screws, rods, pins and combinations thereof; and a pivot (87) located above the base plate (86);

a first connector (89) consisting of two side plates (90) and a rear plate (91) connected to the side plates (90), each plate (90 and 91) has at least one through-hole (92); the connector (89) connects to a plate (3), aligning a through-hole (92) on the rear plate (91) with a hole (5) on the plate (3); and a first bracing newel (88) with:

a first connecting plate (93) located at one longitudinal end of the first bracing parallel (88), the first connecting plate (93) has a through-hole (92 that aligns with the through-holes (92) of the side plates (90) of the second connector (96) to insert a fixing means (7); and a second connection circuit plate (94) longitudinally opposite to the first connection circuit board (93); the second connection circuit plate (94) which is connected to the pivot (87) by fixing means (7) passing through the connection circuit plate (94) and the pivot (87).

In an invention embodiment, the base plate (86) may be rectangular, circular, regular polygonal, irregular polygonal, ellipsoidal, oblong, or combinations thereof.

In an invention embodiment, each bracing block (84) includes a second connector (96) equal to the first connector (89) connected to a plate (3) of the wall formwork (78) and a second bracing parallel (95) with:

a first connecting plate (93) located at one longitudinal end of the second bracing parallel (95), the first connecting plate (93) has a through-hole (92) that aligns with the through-holes (92) of the side plates (90) of the second connector (96) to insert a fixing means (7); and a second connection circuit plate (94) longitudinally opposite the first connection circuit board (93); the second connection circuit plate (94) which is connected to the pivot (87) by means of fasteners (7) passing through the connection circuit plate (94) and the pivot (87)

This way, the two bracing newels (88 and 95) are supported on the same base plate (86), saving space on the job site and reducing the number of elements, if compared with the case in which each bracing pair (88 and 95) has its own base support (86).

On the other hand, the formwork mechanism of the present invention may be conformed from:

at least one coffer (1) comprising a sheet (2) and a plate (3) arranged on the perimeter of the sheet (2), the plate (3) has holes (5) arranged on its front face; and at least one structural element (4) connected to the plate (3) with fixing means (7), the structural element (4), has lateral perforations (9) which are aligned with the holes (5) of the plate (3) on the coffer (1);

where the fixing means (7) pass through the holes (5) and the lateral perforations (9).

In this case, the structural element (4) has at least one joist (13), each joist (13) has a side hole (14) aligned with a hole (5) in a plate (1); where the structural element (4) is secured to the plate (1) with a fixing means that crosses the side hole (14) and hole (5); and where each joist (13) includes a first pivot (14A) connected to a joint (120).

The formwork mechanism allows a mold to be formed to pour a rectangular concrete reticular slab, which may vary its thickness in one or two coplanar directions, for example, in a horizontal direction and a transverse direction that is orthogonal to the horizontal direction.

The articulation (120) and the first pivot (14A) make it possible to generate a flexible angular joint between two structural elements (4), for example, between a beam (8) and an L (111B), a T (50C) or a cross (28B).

Preferably, as may be seen in FIG. 10A-10E, the joint (120) is composed of a support connected to a structural element (4) by a tongue and groove joint, where the support has a second pivot (14A) aligned with a first pivot (14A) of a joist (13); and a pin that runs through the pivots (14A) of the joist (13) and the support.

This way, the assembly of the support to the structural element (4) is faster than the case of using other fixing means, such as screws, bolts, or rivets. In addition, this assembly allows for easy replacement of the joint support (120).

This is important because the joint elements (120), particularly the support, are subjected to shear stresses generated by the weight of the concrete poured onto the coffers (1) and the structural elements (4) to form the slab. Therefore, this joint support (120) tends to wear more easily than the structural element (4), so it is convenient to be able to disconnect it and connect it quickly, as allowed by the tongue and groove joint.

For example, FIG. 10A-10B show a form of tongue and groove joint to connect a joint support (120) to a beam (8). In this case the beam (8) has at its longitudinal ends male protuberances, where each male protuberance is inserted into a female cavity located in the joint support (120).

For their part, the pivots (14A) are perforations that pass through the joint support (120) and the structural element (4). The pivots (14A), in combination with the pin allow two structural elements (4) connected by the joint (120) to rotate in relation to a horizontal axis.

Referring to FIG. 10A-10E, the structural element (4) may have at least two joists (13), where each joist (13) includes a first pivot (14A) connected to a joint (120). In this case the structural element (4) may be selected between:

- an L (111B) composed of two joists (13) orthogonal to each other;
- a T (50C) composed of three joists (13), where two joists (13) are collinear with each other, and one joist (13) is orthogonal to the joists (13) collinear; and
- a cross (28B) composed of four joists (13) equiangularly separated from each other.

The L (111B) is connected in a corner of a coffer (1) located in the position where a corner of a mold is defined for a rectangular reticular slab, where the mold is formed with the formwork mechanism of the present invention.

For its part, the T (50C) allows to connect between them two coffers (1) located along the edge of the mold where the edge of the slab would be located. Accordingly, to form the mold perimeter of a reticulated rectangular slab, Ls (111B) are installed in the mold corners, where each L (111B) is coupled to a coffer (1) located in a corner. Then the Ts (50C) are connected to the L (111B) for initial formation of the slab edges.

Referring to FIG. 10A-10E, Ts (50C) may be connected to L (111B) by means of beams (8), where each beam (8) is connected to a joist (13) of a T (50C) and to a joist (13) of an L (111B) by means of the articulation (120).

The other Ts (50C) composing the edge of the mold where the edges of the slab would be located, can also be connected by beams (8), where each beam (8) is connected to a joist (13) of a T (50C) by articulation (120). This allows the Ts (50C) and Ls (111B) to be kept in a horizontal position, while the beams (8) are tilted with respect to a horizontal plane.

Each cross (28B) is connected to four coffers (1) with fixing means (7) that go through the holes (5) and the side holes (14). In addition, crosses (28B) may be connected to each other by means of beams (8), where each beam (8) is connected to a joist (13) of a cross (28B) by means of the joint (120). This makes it possible to keep the crosses (29) in a horizontal position, while the beams (8) are inclined with respect to a horizontal plane.

Additionally, Ts (50C) may be connected to crosses (28B) to form the mold from the mold edges to its center, adding and connecting crosses (28C) with beams (8) and joints (120). In this way, the crosses (28B) allow the rest of the mold to be formed for the rectangular reticular slab.

Referring to FIG. 10A-10E, above the structural elements (4), such as Ts (50C), crosses (28B), beams (8) and L (111B), boards (41) may be arranged, where the boards (41) allow to form a continuous surface on which the liquid concrete will be supported.

The boards (41) may be made of wood, plastic or metal. Also, the boards (41) may be rigid or flexible.

Rigid boards (41) are ideal for the construction of formworks for homogeneous cross-section reticular slabs; flexible boards (41) are ideal for the construction of variable cross-section beams and reticular slabs, as they allow a curve to be described that interconnects crosses (29), beams (8) and/or Ts (50).

The holes (5) of the plate (3) on the coffers (1) can form on the coffer (1) after connecting the plates (3) to the sheet (2). For example, holes (5) may be drilled or punctured.

On the other hand, the formwork mechanism of the present invention may be composed from:

- at least one coffer (1) composed of a sheet (2) and a plate (3) arranged on the perimeter of the sheet (2), the plate (3) has holes (5) arranged on its front face; and
- at least one structural element (4) connected to the plate (3) with fixing means (7), the structural element (4), has lateral perforations (9) which are aligned with the holes (5) of the plate (3) on the coffer (1);
- where the fixing means (7) pass through the holes (5) and the lateral perforations (9).

In this case the structural element (4) is a load support (107) that has at least one female profile (108) attached to a male profile (109), each profile (108, 109) includes a support through-hole (110) aligned with a plate (3) hole (5); where the load support (107) is secured to the plate (3) with a fixing means passing through the support through-hole (110) and the plate (3) hole (5).

The female profile (108) may have a cross section with a concave portion, e.g. a C or U cross section.

In particular, the cross section of the female profile (108) may have approximate dimensions from 200 mm to 350 mm long, 50 mm to 90 mm wide and a thickness from 20 mm to 50 mm.

The male profile (109) has a transverse section with a protruding portion that is inserted into the concave portion of the female profile (108). For example, the male profile (109) may be an L-, T- or C-cross section profile.

In particular, the cross section of the male profile (109) may have approximate dimensions from 200 mm to 350 mm long, 50 mm to 100 mm wide and a height from 70 mm to 110 mm.

The profiles (108, 109) include a supporting through-hole (110) in which a fixing means may be arranged to connect the profiles (108, 109) to each other.

For example, to fix the profiles (108, 109), a nut (108A) embedded in one of the profiles (108, 109) may be arranged, which has its thread coinciding with the support through-hole (110). The nut (108A) is connected with a screw (108B) going through a hole (5) in a plate (3) of an inclined coffer (1). In this way, the screw (108B) together with the nut (108A) allow the profiles (108, 109) to be connected to the inclined coffers (1).

In order to ensure the profiles (108, 109) adjust to the inclined geometry of the plates (3) of inclined coffers (1), the profiles (108, 109) have inclined surfaces on their external side faces, i.e. the side faces of the profiles (108, 109) coming into contact with the plates (3).

In this case, when the coffer (1) is assembled, it is assembled in such a way the coffer (1) is left with a demolding angle, which may vary from 0° to 10°. In order to achieve this, connect the plates (3) with the punctured tabs (6) to the inclined corner profiles (11) with the punctured tabs (12), and secure the equine profiles (11) to the plates (3) with fixing means (7).

Optionally, each profile (108, 109) may include a nut (108A), where the nuts (108A) are arranged concentrically opposite each other, so the same screw (108B) may be connected to both nuts (108A).

Preferably, the screw (108B) has a through-hole in which a wedge pin is inserted ensuring the union of the profiles (108, 109) with the plates (3).

On the other hand, the load support (107) rests on a bracket (114); where the bracket (114) includes a protrusion that connects to an adjustable guide (113) located on a vertical support.

The bracket (114) allows to transfer the weight of the coffers (1) to the vertical supports, which are connected to blocks (30). In addition, the bracket (114) preferably has a flat surface on a top face which is parallel to a bottom face of the profiles (108, 109).

On the other hand, the vertical support can include a vertical profile with a rectangular cross section and at least two adjustable guides (113), each adjustable guide (113) is located on one side of the vertical profile with a rectangular cross section.

The adjustable guides (113) prevent the movement of the bracket (114) in a horizontal plane orthogonal to the vertical support. In addition, the adjustable guides (113) allow the bracket (114) to slide vertically, allowing the height of the load support (107) to be adjusted to align the support through-holes (110) with the holes (5) in the coffers (1).

For example, the vertical support may be selected from among:

- an L-type support (111C) which has two adjustable guides (113) located on two orthogonal sides of the vertical profile with rectangular cross section;
- a T-type support (50C) consisting of three adjustable guides (113), where two adjustable guides (113) are located on two parallel sides of the vertical rectangular cross-section profile;
- a cross type support (28C) consisting of four adjustable guides (113), each adjustable guide (113) located on one side of the vertical profile with a rectangular cross section.

The L-type bracket (111C) allows you to connect two brackets (114), each bracket (114) connected to an adjustable guide (113). The L-type support (111C) is installed in the corners of a mold for a rectangular reticular slab. In this case, the bracket (114) holds two load supports (107) connected to a corner of a coffer (1) located in the mold corner.

For its part, the T-type support (50C) allows you to connect three brackets (114), each bracket (114) connected to an adjustable guide (113). The support L-type (111C) allows to connect two coffers (1) located along the mold edge where the edge of the slab would be located.

Accordingly, in order to form the mold perimeter of a reticulated rectangular slab, L-type supports (111C) are arranged in the mold corners, where each bracket (114) of each L (111C) holds a load support (107) which is attached to a coffer (1) located in a corner.

Referring to FIG. 11A-11K and FIG. 12A-12J, the mold edges for rectangular reticular slabs are formed by means of the T supports (50C) and their respective bracket (114) which hold three load supports (107). The load brackets (107) attached to the T-type brackets (50C) are connected to the coffers (1) located on the mold edges.

Finally, in order to form the inside of the mold, cross type brackets (28C) are arranged, where each cross type bracket (28C) has four bracket (114) holding four load supports (107), which are connected to four coffers (1).

On the other hand, each vertical support may include:

- a lower end having a tab, with at least one threaded hole aligned with an adjustable guide (113); and
- at least one support screw (112) connected to the threaded hole;

where the protrusion of the bracket (114) is inserted into the adjustable guide (113) and rests on the support screw (112).

One of the functions of the support screws (112) is to adjust the bracket height (114). Preferably, the support screws (112) are square threaded for heavy load support.

On the other hand, the coffer (1) of the formwork mechanism of the present invention may include in its sheet (2) at least one orthogonal stiffening profile (2B) coupled to an internal face of the sheet (2) and extending between two plates (3) parallel to each other.

In addition, the sheet (2) may include at least one diagonal stiffening profile (2C) attached to one inner side of the sheet (2);

- where the sheet (2) has four vertices coinciding with a corner profile (11);
- where the diagonal stiffening profile (2C) extends between two opposite corners of the sheet (2) forming an acute angle with the orthogonal stiffening profile (2B).

For example, the sheet (2) may include six orthogonal stiffening profiles (2B) as shown in FIG. 13A-13C, where three of the orthogonal stiffening profiles (2B) are orthogonal with the other three orthogonal stiffening profiles (2B).

In addition, as illustrated in FIG. 13, each orthogonal stiffening profile (2B) has a geometry similar to the sheet (2) and a thickness between 1 mm to 10 mm, which varies its section, allows the sheet (2) to have a better shape and stiffness and also has another diagonal stiffening profile (2C) with a geometry similar to the orthogonal stiffener (2B) and thus increasing the stiffness of the sheet (2) compared to a sheet (2) without reinforcements.

The stiffening profiles (2B, 2C) transmit the load directly to the stiffening profile (48) of the plate (3) because, as illustrated in FIG. 13 coincide in space and the orthogonal stiffeners (2B) rest on the rigidizing profile (48) of these loads are transmitted and supported by a fixing means, such as a pin wedge, screw, bolt or flap, where the fixing means is connected to a structural element (4), e.g. a beam (8). For its part, the structural element (4) is connected to a block (3) transmitting the load of the coffers (1) and the concrete that the coffers (1) and structural elements (4) load towards the ground.

Referring to FIG. 11A-11K and FIG. 12A-12J, on top of the load supports (107), boards (41) may be arranged, where the boards (41) allow to form a continuous surface on which the liquid concrete will be supported.

The boards (41) may be made of wood, plastic or metal. Also, the boards (41) may be rigid or flexible.

Rigid boards (41) are ideal for the construction of forms for homogeneous cross-section reticular slabs; flexible boards (41) are ideal for the construction of variable cross-section beams and reticular slabs, as they allow a curve to be described that interconnects crosses (29), beams (8) and/or Ts (50).

On the other hand, the coffers (1) of the present invention, as well as their parts (e.g. corner profiles (11), plates (3), sheet (2)) may be made of composite materials formed by polymeric matrix (e.g. polyester, vinylester, epoxy) reinforced with basalt fibers.

Basalt can support greater loads than glass fibers, and allow good performance in humid conditions and temperatures above 50° C., as are the usual conditions during concrete curing.

Moreover, the structural elements (4) can also be made of composite materials composed of polymeric matrix (e.g. polyester, vinylester, epoxy) reinforced with basalt fibers.

On the other hand, with reference to FIG. 13A-13C, the coffers (1) may be arranged in such a way as to form a mold for a reticular parabolic slab. The coffers (1) are assembled in such a way they form arches with parabolic nerves.

In this invention embodiment the coffer (1) may be straight as illustrated in FIG. 14. or it may be a coffer (1) inclined.

In order to construct the mold, coffers are connected (1) at the beginning of the parabola; two coffers are connected (1) as illustrated in FIG. 14A-14D fixed with a hinged support (115B) composed of a leg-joint (119B) which has three holes, one at the end called the hinged through-hole (122A) which allows by fixing means (e.g. a pin, pin, wedge pin, among others) to assemble the configuration parts 119B, 121B, 122D, 117, 121B and 122E, a slightly more centered one called the coffer through-hole (122B) which has the function of allowing the insertion of the non-illustrated pin that crosses the coffers (1) and thus fixing it to the coffer (1) and finally at the other end another assembly through-hole (122C) which allows the part of this configuration 119B and 121B to be assembled and fixed by means of an unillustrated pin, as illustrated in the FIG. 14E.

In order to allow the deflection of the curve, the desired angle is adjusted with small variations (angles may be given between 0° and 90°) by means of an adjustable screw of opposite threads (124) that is articulated at its ends at the bottom (124A) and at the top (124B), located at the leg end of the articulation element—leg (119B), these two joints are joined with non-illustrated pins inserted into the screw through-holes (125) and thus pin the adjustable screw of opposing threads (124) and allow it to perform its work.

Example 1: Straight Coffer

A straight coffer (1) was designed and built according to the following features:

- four plates (3) with the following features:
  - length: 100 cm;
  - height: 50 cm;
  - thickness of punctured tabs (6): 3.18 mm;
  - diameter of the holes on the punctured tabs (6): 11.11 mm;
  - material: ASTM A36 carbon steel sheet of ⅛" (3.18 mm);
  - two diagonal ribs (49);
  - three stiffening profiles (48) arranged vertically, the stiffening profiles (48) located near the punctured tabs (6) on the sides are separated from these 10 mm; the other stiffening profile (48) is located in the center of the plate (3);
  - holes (5) of 17 mm diameter that cross the plate (3) and stiffening profiles (48);
- sheet type (2): convex;
  - sheet height (2): 200 mm;
  - curvature radius: 350 mm;
  - base shape: square having 100 cm sides;
- four corner profiles (11) with the following dimensions:
  - height: 50 cm
  - film thickness: 8 mm
  - length of truncated sides: 50 mm
  - length of sides: 100 mm
  - diameter of perforations on the perforated plates (12): 9.53 mm
- fixing means (7) for interconnecting the plates (3) and the sheet (2): small plates.

Example 2: Inclined Coffer

An inclined coffer (1) with the following features was designed and constructed

- four plates (3) with the following features:
  - length: 100 cm;
  - height: 50 cm;
  - thickness of punctured tabs (6): 3.18 mm;
  - diameter of the holes on the punctured tabs (6): 11.11 mm;
  - material: ASTM A36 carbon steel sheet of ⅛" (3.18 mm);
  - three stiffening profiles (48) arranged vertically, the stiffening profiles (48) located near the punctured tabs (6) on the sides are separated from these 10 mm; the other stiffening profile (48) is located in the center of the plate (3);
  - holes (5) of 17 mm diameter that cross the plate (3) and stiffening profiles (48);
- sheet type (2): convex;
  - sheet height (2): 200 mm;
  - curvature radius: 350 mm;
  - base shape: square having 100 cm sides;
  - angle of punctured tabs (17): 90.14° to horizontal;
- four inclined corner profiles (11) with the following dimensions:
  - height: 500 cm
  - film thickness: 8 mm
  - length of truncated sides: 50 mm
  - upper edge length of sides: 100 mm
  - diameter of perforations on the perforated plates (12): 9.53 mm
  - inclination angle: 90.14° to the horizontal;
- fixing means (7) for interconnecting the plates (3) and the sheet (2): small plates.

Example 3: Formwork for Reticular Slab

A formwork for a reticular slab was designed and built (hereinafter slab formwork). The slab formwork is rectangular and rests on four structural columns (67) of concrete interconnected by concrete structural beams (68).

The coffers (1) on the slab formwork corners are L-type coffers (1) with the following features:

- maximum width and length: 100 cm;
- maximum height: 70 cm;
- a lid (53) with the following features:
  - height: 200 mm;
  - curvature radius of the rounded lateral faces: 350 mm;
  - material: phenolic wood;
  - base shape: square having 100 cm sides with a rectangular cut (54) square having 50 cm sides;
- two external L-plates (55) with the following features:
  - panels width: a panel 30 cm wide and another 60 cm wide;
  - panel height: 50 cm
  - material: ASTM A36 carbon steel sheet of ⅛" (3.18 mm);
  - thickness of punctured tabs (17): 3.18 mm;
  - diameter of holes on the punctured tabs (7): 11.11 mm; and
  - diameter of holes (5): 17 mm
- a first inner L-plate (56) and a second inner L-plate (57) with the following features:

panels width: 25 cm wide and another 60 cm wide;
panels height: 50 cm
material: ASTM A36 carbon steel sheet of ⅛" (3.18 mm);
thickness of punctured tabs (17): 3.18 mm;
diameter of holes on the punctured tabs (17): 11.11 mm;
diameter of holes (5): 17 mm a first flat plate (58) with the following features:
height: 50 cm;
width: 25 cm;
thickness of punctured tabs (17): 3.18 mm;
diameter of holes on the punctured tabs (17): 11.11 mm;
diameter of holes (5): 17 mm a second flat plate (59) of phenolic wood 50 cm high, 25 cm wide and 15 mm thick;

fixing means (7): steel pin-nuts, self-drilling screws, bolts and punches.

In the rectangular cut (54) of the L-type coffers (1) there are non-recoverable square plates (69) of polystyrene, which are 25 cm on the sides and 10 mm thick.

The coffers (1) of the slab formwork periphery are sliding coffers (1) with the following dimensions and features:

a first cap (61) with the following features
length of rear edge (63): 1200 mm
length of side edges (65): 600 mm
maximum height: 700 mm
three rows of holes (5) located on the back plate (52); one row of holes (5) located on the center of the sheet top face (2); and two rows of holes (5) located on the side plates (66); each hole (5) is countersunk and is 12.7 mm in diameter, the holes (5) are 50 mm apart;
material: ASTM A36 carbon steel sheet of ⅛" (3.18 mm);

a second cap (62) with the following features:
length of rear edge (63): 1184 mm
length of side edges (65): 600 mm
maximum height: 692 mm
three rows of holes (5) located on the back plate (52); one row of holes (5) located on the center of the sheet top face (2); and two rows of holes (5) located on the side plates (66); each hole (5) is countersunk and is 12.7 mm in diameter, the holes (5) are 50 mm apart;
material: ASTM A36 carbon steel sheet ⅛" (3.18 mm);

The caps (61 and 62) are secured to each other by fixing means (7), which are pin-wedges and plates.

The rest of the coffers (1) are straight coffers (1) as in example 1.

The coffers (1) are interconnected with crosses (29) with the following features:
length of joists (13): 235 mm
width of joists (13): 100 mm
material: ASTM A36 carbon steel sheet, 10 mm thick;
height of joists (13): 83 mm
radius of the joists upper rounding (13): 3000 mm
diameter of side holes (14): 17 mm
location of side holes (14): 50 mm above the bottom edge and 35 mm from the side edge of each joist (13);

On the crosses (29) there are phenolic wood boards (41) joining the crosses (29) with self-drilling screws. The boards (41) are 100 mm wide, 120 cm long, and 15 mm thick.

It must be understood that the present invention is not limited to the embodiments described and illustrated herein, given that as it will be evident for any skilled artisan, possible variations and modifications exist which do not depart from the invention scope and spirit, which is only defined by the following claims.

The invention claimed is:

1. A formwork mechanism comprising:
a coffer comprises a sheet and a plate arranged around the perimeter of the sheet, the plate having a plurality of holes arranged on a front face thereof; and
a structural element connected to the plate with fixing means, the structural element having lateral perforations aligned with individual ones of the plurality of holes of the coffer plate, the fixing means being configured to pass through individual, corresponding ones of the plurality of the holes and the lateral perforations, the coffer further comprising:
a first plurality of punctured tabs disposed on a periphery of the sheet,
a second plurality of punctured tabs disposed on a periphery of the plate, each one of the second plurality of punctured tabs connected to a corresponding one of the first plurality of punctured tabs by the fixing means, and
four corner profiles, each one of the four corner profiles having two individual ones of a third plurality of perforated tabs, each one of the third plurality of perforated tabs being connected to a corresponding one of the second plurality of punctured tabs,
the structural element being configured to move vertically to align with the holes, the holes being disposed at different heights along the plate.

2. The formwork mechanism of claim 1, wherein the coffer comprises the sheet and four plates arranged around the perimeter of the sheet, each of the four plates having individual ones of the plurality of holes arranged on its front face.

3. The formwork mechanism of claim 1, wherein the structural element is a beam with lateral perforations arranged on lateral faces thereof.

4. The formwork mechanism of claim 3, wherein the beam comprises a first structural profile and a skid that slides with respect to the first structural profile, the skid comprising the lateral perforations.

5. The formwork mechanism of claim 2, the sheet is convex.

6. The formwork mechanism of claim 1, wherein the structural element is a T, the T having three joists, each joist having a side hole which is aligned with a corresponding one of the plurality of holes.

7. The formwork mechanism of claim 6 further comprising a second coffer with a substantially equivalent structure, the T being connected to the two coffers by the fixing means.

8. The formwork mechanism of claim 2, wherein the structural element is a cross comprising four joists, each joist having a side hole which is aligned with corresponding one of the plurality of holes.

9. The mechanism of claim 2, wherein a spacer is connected to one of the plurality of holes, the spacer comprising:
a threaded rod with a first end and a second end, the threaded rod configured to pass through the hole;
two wing nuts, a first of the two wing nuts being connected to the first of the threaded rod end and a second of the two wing nuts being connected to the second end of the threaded rod;
a nut connected to the threaded rod, the plate being disposed between the nut and one of the wing nuts;
a stop connected to the threaded rod between the first end and the second end; and a tube arranged concentrically with the threaded rod, the threaded rod configured to pass through an external plate and between the plates and the tube is being disposed in a set position.

10. The formwork mechanism of claim 2, further comprising a hanging beam formwork connected under a plate of the coffer, the hanging beam formwork comprising:

a first extension plate connected to the plate;

a second extension plate located at the front of the extension plate; wherein the extension plates have holes arranged on their front faces; and a support beam connected to the holes of the extension plates with fixing means, wherein the second extension plate is connected to another coffer.

11. The formwork mechanism of claim 10, wherein the supporting beam comprises:

a block with a plurality of perforations arranged along its entire length;

a support surface at the upper end of the block;

two angles connected below the supporting surface, each angle having a connecting port at its inner vertex and side holes, wherein the side holes are aligned with the holes;

a hub of adjustable internal diameter, with two ears extending radially, the hub is concentrically arranged with respect to the block;

a fixing means that passes through one of the holes in the block, the fixing means is located under the hub;

two extensible brackets, each extensible bracket is connected to one hub ear, and to the connecting port of an angle; and a flexible sheet resting on the supporting surface.

12. The formwork mechanism of claim 11, wherein the flexible sheet has at one longitudinal end, a punctured tab connected to a column formwork, the punctured tab comprising:

a curved panel with:

a first perforated tab connected to the punctured tab with fixing means;

a second perforated tab connected to the plate being disposed in a vertical arrangement;

one of the plurality of a holes being located between the first perforated tab and the second perforated tab of the curved panel;

an adapter with a curved perforated surface connecting to one of the plurality of holes of the curved panel with fixing means; the adapter further comprising a horizontal plate that has a cavity; and a block with a male adapter located at upper longitudinal end thereof, which is inserted into the adapter cavity.

13. The formwork mechanism of claim 1 further comprising:

a first module consisting of a first group of two plates connected to each other and arranged in parallel, the first module having an inclination;

a second module consisting of a second group of two plates connected to each other and arranged in parallel, the second module having an inclination;

a first support beam with two punctured tabs arranged on its corresponding side faces thereof, each punctured tab of the first support beam being connected to a punctured tab of each of the two plates of the first module or the second module; and a second support beam with two punctured tabs arranged on corresponding side faces thereof, each punctured tab of the second support beam being connected to a punctured tab of each of the two plates of the second module, wherein the punctured tabs of the support beams form an angle between 0° and 180°.

14. The formwork mechanism of claim 1, wherein the coffer is a L-type coffer comprising:

a trapezoid-shaped lid with rounded side faces; the lid having a rectangular cut in one of its corners;

two outer L-panels connected to corners of the trapezoid-shaped lid with short bottom edges; and a first inner L-plate connected to a lower edge of the rectangular cut and a second inner L-plate connected to the two outer L-panels;

each L-plate is composed of two panels connected to each other at 90°; each L-plate and has at its top edge, punctured tabs;

a first flat plate configured to slide-on to an outer L-plate, the first flat plate has punctured tabs; and a second flat plate connected between the first flat plate and an inner L-plate.

15. The formwork mechanism of claim 1, wherein the coffer is a sliding coffer comprising:

a first cap and a second cap which is housed inside the first cap in a sliding manner; each of the first cap and the second cap having:

one sheet oriented horizontally, with one rear edge, one front edge, and two side edges;

a rear plate connected to the rear edge of sheet; and two side plates connected to the side edges of the sheet, and connected to the rear plate, wherein the front edge of the sheet and the side edges form a hollow front face, and wherein the hollow front face of the first cap is inserted into the hollow front face of the second cap.

16. The formwork mechanism of claim 1, wherein the structural element has at least one joist, each joist having a side hole that is aligned with a corresponding one of the plurality of a holes of a plate, wherein the structural element is secured to the plate with a fixing means that passes through the side hole and the corresponding one of the plurality of holes, and wherein each joist includes a first pivot connected to a joint.

17. The formwork mechanism of claim 1, wherein the structural element is selected from:

an L comprising two joists orthogonal to each other;

a T composed of three joists, wherein two joists are collinear with each other, and one joist is orthogonal to the two collinear joists; and a cross composed of four joists equiangularly separated from each other.

18. The formwork mechanism of claim 16, wherein the articulation comprises:

a support connected to a structural element by a tongue and groove joint, the support having a second pivot aligned with a first pivot of a joist; and a pin passing through the pivots of the joist and the support.

19. The formwork mechanism of claim 1, wherein the structural element is a load support having at least one female profile attached to a male profile, each of the at least one female profile and the male profile including a supporting through-hole aligned with a corresponding one of the plurality of holes in a plate, the load support being secured to the plate with a fixing means that passes through the support through-hole and the corresponding one of the plurality of holes.

20. The formwork mechanism of claim 19, wherein the load support has at least one nut collinearly connected to the support through-hole of a profile, wherein the load support is secured to the plate with a screw that goes through the support through-hole and the corresponding one of the plurality of holes the screw further connecting to the nut.

21. The formwork mechanism of claim 20, wherein the load support resting on a bracket, the bracket including a protuberance configured to connects to an adjustable guide located on a vertical support.

22. The formwork mechanism of claim 21, wherein the vertical support includes a vertical profile of rectangular cross section and at least two adjustable guides, each one of the two adjustable guides being located on a side of the vertical profile having a rectangular cross section.

23. The formwork mechanism of claim 22, wherein the vertical support is selected from among:

an L-type support which has two adjustable guides located on two orthogonal sides of the vertical profile having a rectangular cross section;

a T-type support consisting of three adjustable guides, wherein two of the three adjustable guides are located on corresponding parallel sides of the vertical profile; and a cross type support consisting of four adjustable guides, each of the four adjustable guides being located on the side of the vertical profile a rectangular cross section.

24. The formwork mechanism of claim 21, wherein the vertical support has:

a lower end that has a tab, with at least one threaded hole aligned with one of the two adjustable guides; and at least one support screw connected to the threaded hole, the protrusion of the bracket being inserted into the adjustable guide and configured to rest on the support screw.

25. The formwork mechanism of claim 5, the wherein the sheet includes at least one orthogonal stiffening profile attached to an internal face of the plate and extending between two of the four plates being parallel to each other.

26. The formwork mechanism of claim 25, wherein the sheet includes at least one diagonal stiffening profile attached to the internal face of the sheet, the sheet comprising four vertices coinciding with a corner profile, the at least one diagonal stiffening profile extending between two opposite corners of the sheet and forming an acute angle with the at least one orthogonal stiffening profile.

27. The formwork mechanism of claim 1, further comprising a plurality of coffers connected to each other with structural elements forming a parabolic structure, the parabolic structure includes:

an articulated support consisting of a leg-joint with three holes;

one articulated through-hole;

a coffer through-hole aligned with a one of the plurality of holes of a coffer plate, wherein a fixing means passes through a corresponding one of the plurality of holes and the coffer through-hole and secures the coffer to the parabolic structure;

assembly through-hole;

a configuration connected to the hinged through-hole with fixing means;

a configuration connected with fixing means to the assembly through-hole;

an adjustable screw with opposing threads that is articulated at its ends at the bottom and at the top, located at the end of the leg of the leg-joint element; and two joints joined with pins that are inserted into through-holes in the screw.

* * * * *